US011693330B2

(12) United States Patent
Anno et al.

(10) Patent No.: US 11,693,330 B2
(45) Date of Patent: Jul. 4, 2023

(54) TONER FOR DEVELOPING ELECTROSTATIC CHARGE IMAGE, ELECTROSTATIC CHARGE IMAGE DEVELOPER, TONER CARTRIDGE, PROCESS CARTRIDGE, IMAGE FORMING APPARATUS, AND IMAGE FORMING METHOD

(71) Applicant: FUJI XEROX CO., LTD., Tokyo (JP)

(72) Inventors: Shintaro Anno, Kanagawa (JP); Yoshimasa Fujihara, Kanagawa (JP); Atsushi Sugawara, Kanagawa (JP); Daisuke Noguchi, Kanagawa (JP); Satoshi Miura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 179 days.

(21) Appl. No.: 17/149,005

(22) Filed: Jan. 14, 2021

(65) Prior Publication Data

US 2022/0091529 A1 Mar. 24, 2022

(30) Foreign Application Priority Data

Sep. 23, 2020 (JP) ..... 2020-159125

(51) Int. Cl.

| | |
|---|---|
| ***G03G 9/087*** | (2006.01) |
| ***G03G 9/097*** | (2006.01) |
| ***G03G 21/18*** | (2006.01) |
| ***G03G 15/08*** | (2006.01) |
| ***G03G 9/08*** | (2006.01) |

(52) U.S. Cl.

CPC ..... *G03G 9/09708* (2013.01); *G03G 9/0819* (2013.01); *G03G 9/08755* (2013.01); *G03G 9/09733* (2013.01); *G03G 9/09791* (2013.01); *G03G 15/0865* (2013.01); *G03G 21/1814* (2013.01)

(58) Field of Classification Search

CPC ..... G03G 9/08755; G03G 9/09708; G03G 9/09791

See application file for complete search history.

(56) References Cited

U.S. PATENT DOCUMENTS 10,585,368 B2 3/2020 Ueda et al.
2003/0190540 A1* 10/2003 Shoshi ..... G03G 5/078 430/96

FOREIGN PATENT DOCUMENTS

JP 11-237766 A 8/1999
JP 2014-006339 * 1/2014 ..... G03G 9/087

(Continued)

OTHER PUBLICATIONS

Translation of JP 2017-167440.*
Translation of JP 2014-006339.*

*Primary Examiner* — Peter L Vajda
(74) *Attorney, Agent, or Firm* — Sughrue Mion, PLLC

(57) ABSTRACT

A toner for developing an electrostatic charge image contains toner particles containing at least one binder resin; the Mg element in an amount such that the net intensity of x-ray fluorescence from the Mg element in the toner is 0.10 kcps or more and 1.20 kcps or less; and external additives including particles of at least one compound represented by formula (1) and particles of a metal salt of a fatty acid, $$MTiO_3 \quad (1)$$

where M represents at least one selected from the group consisting of Ca, Sr, and Ba.

17 Claims, 3 Drawing Sheets

(56) References Cited

FOREIGN PATENT DOCUMENTS

| | | | | |
|---|---|---|---|---|
| JP | 2017-167440 | * | 9/2017 | ..... G03G 9/08 |
| JP | 2019-120846 A | | 7/2019 | |

* cited by examiner

TONER FOR DEVELOPING ELECTROSTATIC CHARGE IMAGE, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2020-159125 filed Sep. 23, 2020.

BACKGROUND

(i) Technical Field

The present disclosure relates to a toner for developing an electrostatic charge image, an electrostatic charge image developer, a toner cartridge, a process cartridge, an image forming apparatus, and an image forming method.

(ii) Related Art

Electrophotography and other techniques for visualizing image information are used in various fields today. In electrophotographic visualization of image information, the surface of an image carrier is charged, and an electrostatic charge image, which is the image information, is created thereon. Then a developer, which contains toner, is applied to form a toner image on the surface of the image carrier. This toner image is transferred to a recording medium and fixed on the recording medium.

Japanese Unexamined Patent Application Publication No. 11-237766, for example, discloses a color toner that contains (i) color toner particles containing at least a binder resin and a colorant and (ii) external additives. The color toner is characterized in that (a) the particles of the color toner have a weight-average diameter of 5 to 8 μm and a number-average diameter of 4.5 to 7.5 μm, the percentage of particles having a diameter of 4 μm or less in the color toner is between 5% and 40% by number, and the percentage of particles having a diameter of 10.08 μm or more in the color toner is 7% by volume or less; (b) the external additives include an inorganic powder selected from the group consisting of a powder of strontium titanate, a powder of cerium oxide, and a powder of calcium titanate and also include a fine powder of hydrophobic alumina, the particles of the inorganic powder have a length-average diameter of 0.2 to 2 μm, and the particles of the fine powder of hydrophobic alumina have a length-average diameter of 0.005 to 0.1 μm; (c) the binder resin is a polyester resin crosslinked by a crosslinker; (d) each gram of the color toner particles contains 0 to 20 mg of chloroform-insoluble components; and (e) the color toner has a storage modulus at a temperature of 130° C. ($G'_{130}$) of $2\times10^3$ to $2\times10^4$ [dyn/cm$^2$] and a storage modulus at a temperature of 170° C. ($G'_{170}$) of $5\times10^3$ to $5\times10^4$ [dyn/cm$^2$], and $G'_{170}/G'_{130}$ is between 0.25 and 10.

Japanese Unexamined Patent Application Publication No. 2019-120846 discloses a toner for developing an electrostatic charge image that contains base particles and an external additive on the surface thereof. The external additive contains particles of calcium titanate having an average primary-particle diameter of 50 to 150 nm and particles of alumina, and the particles of alumina have an average primary-particle diameter equal to or smaller than that of the particles of calcium titanate.

SUMMARY

Aspects of non-limiting embodiments of the present disclosure relate to a toner for developing an electrostatic charge image that contains toner particles containing a binder resin and also contains external additives. With this toner, images may have fewer voids than with toners that contain Mg in an amount such that in an x-ray fluorescence analysis of the toner, the net intensity of the peak for Mg is less than 0.10 kcps or more than 1.20 kcps or with toners in which particles of silica are the only external additive.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a toner for developing an electrostatic charge image. The toner contains toner particles containing at least one binder resin; a Mg element in an amount such that a net intensity of x-ray fluorescence from the Mg element in the toner is 0.10 kcps or more and 1.20 kcps or less; and external additives including particles of at least one compound represented by formula (1) below and particles of a metal salt of a fatty acid, $$MTiO_3 \quad (1)$$

where M represents at least one selected from the group consisting of Ca, Sr, and Ba.

BRIEF DESCRIPTION OF THE DRAWINGS

Exemplary embodiments of the present disclosure will be described in detail based on the following figures, wherein.

DETAILED DESCRIPTION

Figure 1:
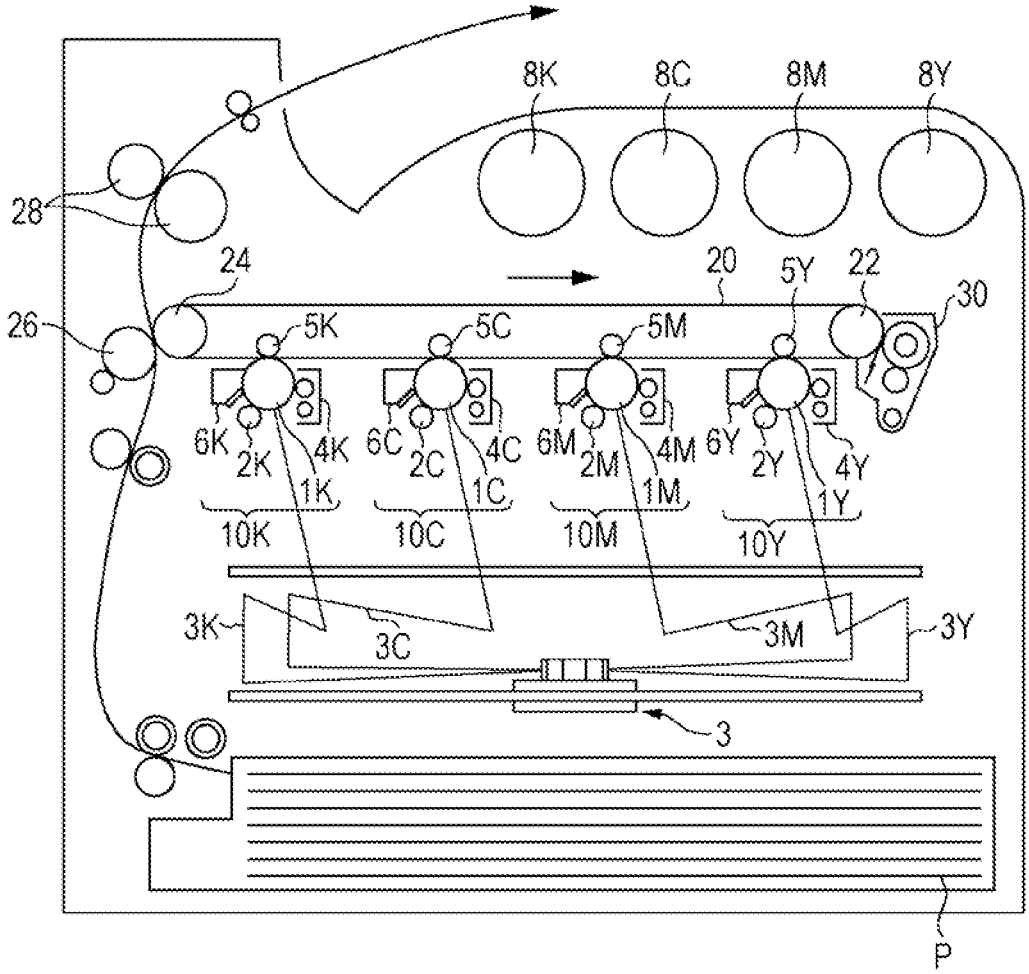
FIG. 1 is a schematic view of the structure of an example of an image forming apparatus according to an exemplary embodiment.

The following describes exemplary embodiments of the present disclosure in detail.

The following description includes series of numerical ranges. In such a series, the upper or lower limit of a numerical range may be substituted with that of another in the same series.

The upper or lower limit of a numerical range, furthermore, may be substituted with a value indicated in the Examples section.

An ingredient of a composition described herein may be a combination of multiple substances. In that case, the amount of the ingredient in the composition is the total amount of the multiple substances in the composition unless stated otherwise.

A gerund or action noun used in relation to a certain process or method herein does not always represent an independent action. As long as its purpose is fulfilled, the action represented by the gerund or action noun may be continuous with or part of another.

Toner for Developing an Electrostatic Charge Image

A toner according to an exemplary embodiment for developing an electrostatic charge image contains toner particles containing at least one binder resin; the Mg element in an amount such that the net intensity of x-ray fluorescence from the Mg element in the toner is 0.10 kcps or more and 1.20 kcps or less; and external additives including particles of at least one compound represented by formula (1) and particles of a metal salt of a fatty acid, $$MTiO_3 \quad (1)$$

where M represents at least one selected from the group consisting of Ca, Sr, and Ba.

Particles of a compound represented by formula (1) (hereinafter also referred to simply as "particles of formula (1)") are highly hygroscopic. If a toner containing them is used with an image forming apparatus under humid conditions, therefore, the particles become sticky and affect the flow of the toner and external additives at the area of contact between the cleaning blade and the image carrier (blade nip), where the toner and external additives accumulate. The reduced flow causes an increased strain on the blade, causing the blade to polish the image carrier too strongly. As a result, the blade nip wears unevenly between its portion through which no recording medium passes and its image portion because of different amounts of toner supply. The inventors found that this uneven wear escalates especially after a high-load "stress" run, during which the external additives sink deep in the toner and affect the flow there seriously. Once this occurs, images may often have voids because the particles of formula (1) are easily concentrated in the worn portion.

If toner particles contain the Mg element, adsorbed water adheres preferentially to the Mg compound present near the surface of the toner particles. If such toner particles further contain particles of formula (1) and particles of a metal salt of a fatty acid (hereinafter also referred to as "metal salt particles") as external additives, these particles bind with the water adsorbed by the toner particles. At the blade nip, the metal salt particles form loose aggregates around the toner particles and particles of formula (1) as cores. The loose aggregates of the metal salt particles are formed at the image portion of the blade nip and produce a lubricating coating of a metal salt of a fatty acid there. This lubricating coating limits wear on the blade nip. In particular, after a stress run, or when the external additives have sunk deeper in the toner, the metal salt particles adhere to the toner particles more easily, because the surface of the toner particles has been more exposed. In that state the loose aggregates of the metal salt particles are formed more easily. Uneven wear on the blade nip is therefore limited even after a stress run. This may help control voids in images.

Net Intensity of the Peak for the Mg Element in the Toner in an X-Ray Fluorescence Analysis The toner according to this exemplary embodiment for developing an electrostatic charge image contains the Mg element in an amount such that in an x-ray fluorescence analysis of the toner, the net intensity of the peak for the Mg element is 0.10 kcps or more and 1.20 kcps or less. The net intensity of the peak for the Mg element may be 0.15 kcps or more and 1.10 kcps or less in view of better control of density unevenness and voids in the image. Preferably, the net intensity of the peak for the Mg element is 0.20 kcps or more and 1.00 kcps or less.

The Mg element in the toner according to this exemplary embodiment for developing an electrostatic charge image can be from any source. Examples of sources include a magnesium flocculant, such as magnesium chloride, and its residue and a magnesium salt used as an additive.

The x-ray fluorescence analysis of the toner and the measurement of the net intensity of the peak for the Mg element can be as follows.

Approximately 5 g of the toner (including the external additives) is compressed using a compression molding machine under a load of 10 t for 60 seconds to give a 50-mm diameter and 2-mm thick disk. This sample disk is qualitatively and quantitatively analyzed for chemical elements therein under the conditions below using a scanning x-ray fluorescence spectrometer (Rigaku ZSX Primus II). In the resulting spectrum, the net intensity of the peak for the Mg element (in kcps, kilo-counts per second) is determined.

Tube voltage: 40 kV
Tube current: 70 mA
Anticathode material: Rhodium
Duration of measurement: 15 minutes
Spot diameter: 10 mm External Additives Particles of at Least One Compound Represented by Formula (1)

The toner according to this exemplary embodiment for developing an electrostatic charge image contains, as an external additive, particles of at least one compound represented by formula (1) (particles of formula (1)).

$$MTiO_3 \quad (1)$$

In formula (1), M represents at least one selected from the group consisting of Ca, Sr, and Ba.

In view of better control of density unevenness and voids in the image, the M in formula (1) may be Ca.

That is, the particles of formula (1) may be particles of calcium titanate.

The particles of formula (1) only need to contain 50% by mass or more the compound represented by formula (1). The percentage of the compound represented by formula (1) may be 80% by mass or more, preferably 90% by mass or more, more preferably 95% by mass or more and 100% by mass or less.

The average primary-particle diameter of the particles of formula (1) may be 10 nm or more and 5,000 nm or less. This may also lead to better control of density unevenness and voids in the image. Preferably, the average primary-particle diameter of the particles of formula (1) is 30 nm or more and 3,000 nm or less, more preferably 50 nm or more and 1,000 nm or less, even more preferably 60 nm or more and 500 nm or less, in particular 70 nm or more and 130 nm or less.

In this exemplary embodiment, the diameter of particles of an external additive (average primary-particle diameter) is the diameter of circles having the same area as the images of primary particles of the additive (so-called equivalent circular diameter). This diameter can be determined by taking an electron microscope image of a toner containing the external additive of interest, such as particles of formula (1) or silica particles, and analyzing at least 300 primary particles of the additive on the toner particles on the image. From the analysis, the frequency-based distribution of diameters of primary particles is determined. The diameter at which the cumulative number of primary particles from the smallest diameter is 50% is the average primary-particle diameter of the external additive.

The ratio D/d1 between the volume-average diameter D of the toner particles, described later herein, and the average primary-particle diameter d1 of the particles of formula (1) may be 1.2 or more and 200 or less. This may also lead to better control of density unevenness and voids in the image. Preferably, the ratio D/d1 is 1.9 or more and 200 or less, more preferably 10 or more and 100 or less, even more preferably 30 or more and 80 or less.

The amount of the particles of formula (1) in the toner according to this exemplary embodiment for developing an electrostatic charge image may be 0.01 parts by mass or more and 2.0 parts by mass or less per 100 parts by mass of the toner particles. This may also lead to better control of density unevenness and voids in the image. Preferably, the amount of the particles of formula (1) is 0.02 parts by mass or more and 1.0 part by mass or less, more preferably 0.05 parts by mass or more and 0.5 parts by mass or less, even more preferably 0.08 parts by mass or more and 0.2 parts by mass or less.

Particles of a Metal Salt of a Fatty Acid

The toner according to this exemplary embodiment for developing an electrostatic charge image contains, as another external additive, particles of a metal salt of a fatty acid (metal salt particles).

The metal salt particles can be, for example, particles of a salt formed by a fatty acid (e.g., stearic acid, 12-hydroxystearic acid, behenic acid, montanic acid, lauric acid, or some other organic acid) and a metal (e.g., calcium, zinc, magnesium, aluminum, or some other metal (such as Na or Li)).

Specific examples of metal salt particles include particles of salts such as zinc stearate, magnesium stearate, calcium stearate, iron stearate, copper stearate, magnesium palmitate, calcium palmitate, manganese oleate, zinc oleate, zinc laurate, and zinc palmitate.

Of these, particles of a zinc salt of a fatty acid may lead to better control of density unevenness and voids in the image and may give the toner better characteristics, for example lubricity, hydrophobicity, and wettability. Preferably, the metal salt particles are particles of zinc stearate, zinc oleate, zinc laurate, or zinc palmitate, more preferably particles of zinc stearate.

The metal salt particles may be a mixture of particles of different metal salts of a fatty acid. The metal salt particles, furthermore, may be particles of a metal salt of a fatty acid and of an extra component. Examples of extra components include higher aliphatic alcohols. The metal salt particles, however, contain 10% by mass or more a metal salt of a fatty acid. The percentage of the metal salt of a fatty acid may be 50% by mass or more, preferably 80% by mass or more, more preferably 90% by mass or more, even more preferably 95% by mass or more and 100% by mass or less.

In view of better control of density unevenness and voids in the image, the volume-average diameter of the metal salt particles may be 0.3 μm or more and 10 μm or less. Preferably, the volume-average diameter of the metal salt particles is 0.5 μm or more and 8 μm or less, more preferably 2 μm or more and 6 μm or less.

The volume-average diameter of the metal salt particles can be measured as follows.

That is, the measuring instrument is LA-920 laser diffraction/scattering particle size analyzer (HORIBA, Ltd.). Parameter setting and analysis of measured data are carried out on HORIBA LA-920 for Windows® WET (LA-920) Ver. 2.02 (HORIBA, Ltd.), dedicated software that comes with LA-920. The measuring solvent is deionized water from which solid and other impurities have been removed.

The amount of the metal salt particles may be 0.01 parts by mass or more and 5 parts by mass or less per 100 parts by mass of the toner particles. This may also lead to better control of density unevenness and voids in the image. Preferably, the amount of the metal salt particles is 0.02 parts by mass or more and 3.0 parts by mass or less, more preferably 0.03 parts by mass or more and 1.0 part by mass or less, even more preferably 0.05 parts by mass or more and 0.5 parts by mass or less.

The ratio D/d2 between the volume-average diameter D of the toner particles, described later herein, and the volume-average diameter d2 of the metal salt particles may be 0.1 or more and 50 or less. This may also lead to better control of density unevenness and voids in the image. Preferably, the ratio D/d2 is 0.2 or more and 20 or less, more preferably 0.5 or more and 10 or less, even more preferably 0.7 or more and 3 or less.

The toner according to this exemplary embodiment for developing an electrostatic charge image may contain, as an extra external additive, particles other than the particles of formula (1) and the metal salt particles.

The number-average diameter of the particles used as an extra external additive in addition to the particles of formula (1) and the metal salt particles may be 5 nm or more and 400 nm or less, preferably 10 nm or more and 200 nm or less.

Any type of particles may be used as an extra external additive in addition to the particles of formula (1) and the metal salt particles. For example, the extra external additive may be inorganic or organic particles.

Examples of inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and $SrTiO_3$.

Examples of organic particles include resin particles (particles of silicone resins, polystyrene, polymethyl methacrylate (PMMA), melamine resins, etc.) and particles of active cleaning agents (e.g., particles of metal salts of higher fatty acids, typically zinc stearate, and particles of fluoropolymers).

Silica particles, titania particles, and silica-titania composite particles are preferred, and silica particles are more preferred.

The amount of extra external additives used in addition to the particles of formula (1) and the metal salt particles may be 0.01 parts by mass or more and 10 parts by mass or less per 100 parts by mass of the toner particles. This may also lead to better control of density unevenness and voids in the image. Preferably, the amount of extra external additives is 0.05 parts by mass or more and 5 parts by mass or less, more preferably 0.1 parts by mass or more and 2 parts by mass or less.

Toner Particles

The toner contains toner particles containing at least one binder resin. Optionally, the toner particles may contain a coloring agent, a release agent, and/or other additives.

Binder Resin(s)

In view of the strength of the image and better control of unevenness in the density of the image, the binder resin may include an amorphous resin and a crystalline resin.

An amorphous resin as referenced herein represents a resin whose thermoanalytical profile as measured by differential scanning calorimetry (DSC) has no clear endothermic peak and only has stepwise endothermic changes. An amorphous resin is solid at room temperature and thermoplasticizes at temperatures equal to or higher than its glass transition temperature.

A crystalline resin as referenced herein represents a resin whose DSC profile has a clear endothermic peak rather than stepwise endothermic changes.

To take a specific example, if a crystalline resin is analyzed by DSC at a heating rate of 10° C./min, the DSC profile has an endothermic peak with a half width of 10° C. or narrower. If an amorphous resin is analyzed likewise, the DSC profile has an endothermic peak with a half width broader than 10° C. or no clear endothermic peak.

The amorphous resin may be as described below.

Examples of amorphous resins include known amorphous resins, such as amorphous polyester resins, amorphous vinyl (e.g., styrene-acrylic) resins, epoxy resins, polycarbonate resins, and polyurethane resins. Of these, the use of an amorphous polyester or amorphous vinyl (styrene-acrylic in particular) resin, preferably an amorphous polyester resin, may lead to even better control of density unevenness and voids in the image.

A combination of amorphous polyester and styrene-acrylic resins may also be used.

An example of an amorphous polyester resin is an polycondensate of a polycarboxylic acid and a polyhydric alcohol. Both commercially available and synthesized amorphous polyester resins can be used.

Examples of polycarboxylic acids include aliphatic dicarboxylic acids (e.g., oxalic acid, malonic acid, maleic acid, fumaric acid, citraconic acid, itaconic acid, glutaconic acid, succinic acid, an alkenylsuccinic acid, adipic acid, and sebacic acid), aromatic dicarboxylic acids (e.g., terephthalic acid, isophthalic acid, phthalic acid, and naphthalenedicarboxylic acid), and anhydrides and lower-alkyl (e.g., C1-5 alkyl) esters thereof. Of these, aromatic dicarboxylic acids are preferred.

A combination of a dicarboxylic acid and a crosslinked or branched carboxylic acid having three or more carboxylic groups may also be used. Examples of carboxylic acids having three or more carboxylic groups include trimellitic acid, pyromellitic acid, and anhydrides and lower-alkyl (e.g., C1-5 alkyl) esters thereof.

One polycarboxylic acid may be used alone, or two or more may be used in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Of these, aromatic diols and alicyclic diols are preferred, and aromatic diols are more preferred.

A combination of a diol and a crosslinked or branched polyhydric alcohol having three or more hydroxyl groups may also be used. Examples of polyhydric alcohols having three or more hydroxyl groups include glycerol, trimethylolpropane, and pentaerythritol.

One polyhydric alcohol may be used alone, or two or more may be used in combination.

The production of the amorphous polyester resin can be by a known method. A specific example is to polymerize raw materials at a temperature of 180° C. or more and 230° C. or less. The reaction system may optionally be evacuated to remove the water and alcohol that are produced as condensation proceeds. If the raw-material monomers do not dissolve or are not miscible together at the reaction temperature, a high-boiling solvent may be added as a solubilizer to make the monomers dissolve. In that case, the solubilizer is removed by distillation during the polycondensation. If one monomer is not miscible with the other(s) in copolymerization, this monomer may be first condensed with an acid or alcohol to be polycondensed therewith, and then the product may be polycondensed with the remaining ingredient(s).

A styrene-acrylic resin is also an example of a binder resin, an amorphous binder resin in particular.

A styrene-acrylic resin is a copolymer of at least a styrene monomer (monomer having the styrene structure) and a (meth)acrylic monomer (monomer having a (meth)acrylic group, preferably a (meth)acryloxy group). Examples of styrene-acrylic resins include copolymers of a styrene monomer and a (meth)acrylate monomer.

A styrene-acrylic resin has an acrylic-resin substructure formed by the polymerization of an acrylic monomer, a methacrylic monomer, or both. The expression "(meth) acrylic" encompasses both "acrylic" and "methacrylic," and the expression "(meth)acrylate" encompasses both an "acrylate" and a "methacrylate."

Specific examples of styrene monomers include styrene, alkylated styrenes (e.g., α-methylstyrene, 2-methylstyrene, 3-methylstyrene, 4-methylstyrene, 2-ethylstyrene, 3-ethylstyrene, and 4-ethylstyrene), halogenated styrenes (e.g., 2-chlorostyrene, 3-chlorostyrene, and 4-chlorostyrene), and vinylnaphthalene. One styrene monomer may be used alone, or two or more may be used in combination.

Of these, styrene is highly reactive and readily available. Its reaction, moreover, is easy to control.

Specific examples of (meth)acrylic monomers include (meth)acrylic acid and (meth)acrylates. Examples of (meth) acrylates include alkyl (meth)acrylates (e.g., methyl (meth) acrylate, ethyl (meth)acrylate, n-propyl (meth)acrylate, n-butyl (meth)acrylate, n-pentyl (meth)acrylate, n-hexyl acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth) acrylate, cyclohexyl (meth)acrylate, and t-butylcyclohexyl (meth)acrylate), aryl (meth)acrylates (e.g., phenyl (meth) acrylate, biphenyl (meth)acrylate, diphenylethyl (meth) acrylate, t-butylphenyl (meth)acrylate, and terphenyl (meth) acrylate), dimethylaminoethyl (meth)acrylate, diethylaminoethyl (meth)acrylate, methoxyethyl (meth) acrylate, 2-hydroxyethyl (meth)acrylate, β-carboxyethyl (meth)acrylate, and (meth)acrylamides. One (meth)acrylic monomer may be used alone, or two or more may be used in combination.

Of these (meth)acrylates, those having a C2-14 (preferably C2-10, more preferably C3-8) alkyl group may help improve fixation of the image.

n-butyl (meth)acrylate is preferred, and n-butyl acrylate is more preferred.

The ratio between the styrene monomer and the (meth) acrylic monomer in the copolymer (by mass; styrene monomer/(meth)acrylic monomer) is not critical. For example, the ratio between the two types of monomers in the copolymer may be between 85/15 and 70/30.

A crosslinked styrene-acrylic resin may also be used. An example is a copolymer of at least a styrene monomer, a (meth)acrylic monomer, and a crosslinking monomer.

An example of a crosslinking monomer is a crosslinking agent that has two or more functional groups.

Examples of bifunctional crosslinking agents include divinyl benzene, divinyl naphthalene, di(meth)acrylate compounds (e.g., diethylene glycol di(meth)acrylate, methylene bis(meth)acrylamide, decanediol diacrylate, and glycidyl (meth)acrylate), polyester-forming di(meth)acrylates, and 2-([1'-methylpropylideneamino]carboxyamino)ethyl methacrylate.

Examples of crosslinking agents having more than two functional groups include tri(meth)acrylate compounds (e.g., pentaerythritol tri(meth)acrylate, trimethylolethane tri (meth)acrylate, and trimethylolpropane tri(meth)acrylate), tetra(meth)acrylate compounds (e.g., pentaerythritol tetra (meth)acrylate and oligoester (meth)acrylates), 2,2-bis(4-methacryloxy, polyethoxyphenyl)propane, diallyl phthalate, triallyl cyanurate, triallyl isocyanurate, triallyl trimellitate, and diaryl chlorendate.

The use of a (meth)acrylate compound having two or more (meth)acrylic groups may help control the events of low image density and uneven image density and may also help improve fixation of the image. Preferably, the crosslinking monomer is a di(meth)acrylate compound, more preferably a di(meth)acrylate compound having a C6 to C20 alkylene group, even more preferably a di(meth)acrylate compound having a linear C6 to C20 alkylene group.

The ratio of the crosslinking monomer to all monomers in the copolymer (by mass; crosslinking monomer/all monomers) is not critical. For example, the ratio of the crosslinking monomer to all monomers may be between 2/1,000 and 20/1,000.

How to produce the styrene-acrylic resin is not critical. A wide variety of polymerization techniques (solution polymerization, precipitation polymerization, suspension polymerization, bulk polymerization, emulsion polymerization, etc.) can be used. The polymerization reactions, furthermore, can be done by known processes (batch, semicontinuous, continuous, etc.).

The styrene-acrylic resin may constitute 0% by mass or more and 20% by mass or less of all binder resins in the toner particles. Preferably, the styrene-acrylic resin content is 1% by mass or more and 15% by mass or less, more preferably 2% by mass or more and 10% by mass or less.

The amorphous resin may constitute 60% by mass or more and 98% by mass or less of all binder resins in the toner particles. Preferably, the amorphous resin content is 65% by mass or more and 95% by mass or less, more preferably 70% by mass or more and 90% by mass or less.

Some characteristics of the amorphous resin may be as described below.

The glass transition temperature (Tg) of the amorphous resin may be 50° C. or more and 80° C. or less, preferably 50° C. or more and 65° C. or less.

This glass transition temperature is that determined from the DSC curve of the resin, which is measured by differential scanning calorimetry (DSC). More specifically, this glass transition temperature is the "extrapolated initial temperature of glass transition" as in the methods for determining glass transition temperatures set forth in JIS K7121: 1987 "Testing Methods for Transition Temperatures of Plastics."

The weight-average molecular weight (Mw) of the amorphous resin may be 5,000 or more and 1,000,000 or less, preferably 7,000 or more and 500,000 or less.

The number-average molecular weight (Mn) of the amorphous resin may be 2,000 or more and 100,000 or less.

The molecular weight distribution, Mw/Mn, of the amorphous resin may be 1.5 or more and 100 or less, preferably 2 or more and 60 or less.

These weight- and number-average molecular weights are those measured by gel permeation chromatography (GPC). The analyzer is Tosoh's HLC-8120 GPC chromatograph with Tosoh's TSKgel SuperHM-M column (15 cm), and the eluate is tetrahydrofuran (THF). Comparing the measured data with a molecular-weight calibration curve prepared using monodisperse polystyrene standards gives the weight- and number-average molecular weights.

The crystalline resin may be as described below.

Examples of crystalline resins include known crystalline resins, such as crystalline polyester resins and crystalline vinyl resins (e.g., polyalkylene resins and long-chain alkyl (meth)acrylate resins). Of these, the use of a crystalline polyester resin may lead to even better control of density unevenness and voids in the image.

An example of a crystalline polyester resin is a polycondensate of a polycarboxylic acid and a polyhydric alcohol. Both commercially available and synthesized crystalline polyester resins can be used.

Crystalline polyester resins made with linear aliphatic polymerizable monomers may readily form a crystal structure compared with those made with aromatic polymerizable monomers.

Examples of polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids, such as phthalic acid, isophthalic acid, terephthalic acid, and naphthalene-2,6-dicarboxylic acid), and anhydrides and lower-alkyl (e.g., C1-5 alkyl) esters thereof.

A combination of a dicarboxylic acid and a crosslinked or branched carboxylic acid having three or more carboxylic groups may also be used. Examples of carboxylic acids having three or more carboxylic groups include aromatic carboxylic acids (e.g., 1,2,3-benzenetricarboxylic acid, 1,2,4-benzenetricarboxylic acid, and 1,2,4-naphthalenetricarboxylic acid) and anhydrides and lower-alkyl (e.g., C1-5 alkyl) esters thereof.

A combination of a dicarboxylic acid such as listed above and a dicarboxylic acid having a sulfonic acid group or an ethylenic double bond may also be used.

One polycarboxylic acid may be used alone, or two or more may be used in combination.

Examples of polyhydric alcohols include aliphatic diols (e.g., C7-20 linear aliphatic diols). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Of these 1,8-octanediol, 1,9-nonanediol, and 1,10-decanediol are preferred.

A combination of a diol and a crosslinked or branched alcohol having three or more hydroxyl groups may also be used. Examples of alcohols having three or more hydroxyl groups include glycerol, trimethylolethane, trimethylolpropane, and pentaerythritol.

One polyhydric alcohol may be used alone, or two or more may be used in combination.

Aliphatic diols may constitute 80 mol % or more of polyhydric alcohols. Preferably, the percentage of aliphatic diols is 90 mol % or more.

The melting temperature of the crystalline polyester resin may be 50° C. or more and 100° C. or less, preferably 55° C. or more and 90° C. or less, more preferably 60° C. or more and 85° C. or less.

The melting temperature of the crystalline polyester resin is the "peak melting temperature" of the resin as in the methods for determining melting temperatures set forth in JIS K7121: 1987 "Testing Methods for Transition Temperatures of Plastics" and is determined from the DSC curve of the resin, which is measured by differential scanning calorimetry (DSC).

The weight-average molecular weight (Mw) of the crystalline polyester resin may be 6,000 or more and 35,000 or less.

The production of the crystalline polyester resin can be by a known method. For example, it may be produced in the same way as the amorphous polyester resin.

The crystalline polyester resin may be a polymer formed by a linear aliphatic α,ω-dicarboxylic acid and a linear aliphatic α,ω-diol. This type of polymer may form a crystal structure readily, and, furthermore, using this type of polymer with an amorphous polyester resin may help improve the fixation of the image by virtue of high miscibility between the resins.

The linear aliphatic α,ω-dicarboxylic acid may be one having a C3 to C14 alkylene group between the two carboxy groups. Preferably, the number of carbon atoms in the alkylene group is 4 or more and 12 or less, more preferably 6 or more and 10 or less.

Examples of linear aliphatic α,ω-dicarboxylic acids include succinic acid, glutaric acid, adipic acid, 1,6-hexanedicarboxylic acid (commonly known as suberic acid), 1,7-heptanedicarboxylic acid (commonly known as azelaic acid), 1,8-octanedicarboxylic acid (commonly known as sebacic acid), 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid. Of these, 1,6-hexanedicarboxylic acid, 1,7-heptanedicarboxylic acid, 1,8-octanedicarboxylic acid, 1,9-nonanedicarboxylic acid, and 1,10-decanedicarboxylic acid are preferred.

One linear aliphatic α,ω-dicarboxylic acid may be used alone, or two or more may be used in combination.

The linear aliphatic α,ω-diol may be one having a C3 to C14 alkylene group between the two hydroxy groups. Preferably, the number of carbon atoms in the alkylene group is 4 or more and 12 or less, more preferably 6 or more and 10 or less.

Examples of linear aliphatic α,ω-diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, 1,14-tetradecanediol, and 1,18-octadecanediol. Of these, 1,6-hexanediol, 1,7-heptanediol, 1,8-octanediol, 1,9-nonanediol, and 1,10-decanediol are preferred.

One linear aliphatic α,ω-diol may be used alone, or two or more may be used in combination.

Preferably, the polymer formed by a linear aliphatic α,ω-dicarboxylic acid and a linear aliphatic α,ω-diol is polymer(s) formed by at least one selected from the group consisting of 1,6-hexanedicarboxylic acid, 1,7-heptanedicarboxylic acid, 1,8-octanedicarboxylic acid, 1,9-nonanedicarboxylic acid, and 1,10-decanedicarboxylic acid and at least one selected from the group consisting of 1,6-hexanediol, 1,7-heptanediol, 1,8-octanediol, 1,9-nonanediol, and 1,10-decanediol, more preferably a polymer formed by 1,10-decanedicarboxylic acid and 1,6-hexanediol. This type of polymer may form a crystal structure more readily, and, furthermore, using this type of polymer with an amorphous polyester resin may lead to further improved fixation of the image by virtue of higher miscibility between the resins.

The crystalline resin may constitute 1% by mass or more and 20% by mass or less of all binder resins in the toner particles. Preferably, the crystalline resin content is 2% by mass or more and 15% by mass or less, more preferably 3% by mass or more and 10% by mass or less.

Other Binder Resins

Other binder resins that may be used include homopolymers of monomers such as ethylenic unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene) and copolymers of two or more such monomers.

Non-vinyl resins, such as epoxy resins, polyurethane resins, polyamide resins, cellulose resins, polyether resins, and modified rosin, mixtures of non-vinyl and vinyl resins, and graft copolymers obtained by polymerizing a vinyl monomer in the presence of a non-vinyl resin are also examples of binder resins that may be used.

One such binder resin may be used alone, or two or more may be used in combination.

The binder resin content may be 40% by mass or more and 95% by mass or less of the toner particles as a whole. Preferably, the binder resin content is 50% by mass or more and 90% by mass or less, more preferably 60% by mass or more and 85% by mass or less.

Release Agent

The toner particles may contain a release agent.

Examples of release agents include hydrocarbon waxes; natural waxes, such as carnauba wax, rice wax, and candelilla wax; synthesized or mineral/petroleum waxes, such as montan wax; and ester waxes, such as fatty acid esters and montanates. Other release agents may also be used.

The use of an ester wax may lead to better control of density unevenness and voids in the image. Using an ester wax with an amorphous polyester resin, furthermore, may help improve the fixation of the image by virtue of high miscibility between the wax and the resin. Ester waxes formed by a C10 to C30 higher fatty acid and a monohydric or polyhydric C1 to C30 alcohol component are preferred.

An ester wax is a wax having an ester bond. An ester wax can be used regardless of whether it is a monoester, diester, triester, or tetraester, and any known naturally occurring or synthetic ester wax can be used.

An example of an ester wax is an ester compound formed by a higher fatty acid (e.g., a C10 or longer fatty acid) and a monohydric or polyhydric aliphatic alcohol (e.g., a C8 or longer aliphatic alcohol) and having a melting temperature of 60° C. or more and 110° C. or less (preferably 65° C. or more and 100° C. or less, more preferably 70° C. or more and 95° C. or less).

Examples of ester waxes, furthermore, include ester compounds formed by a higher fatty acid (e.g., caprylic acid, capric acid, lauric acid, myristic acid, palmitic acid, stearic acid, arachidic acid, behenic acid, or oleic acid) and an alcohol (monohydric alcohol, such as methanol, ethanol, propanol, isopropanol, butanol, capryl alcohol, lauryl alcohol, myristyl alcohol, cetyl alcohol, stearyl alcohol, or oleyl alcohol; or polyhydric alcohol, such as glycerol, ethylene glycol, propylene glycol, sorbitol, or pentaerythritol). Specific examples include carnauba wax, rice wax, candelilla wax, jojoba oil, Japan wax, beeswax, ibotaro wax (wax produced by *Ericerus pela*), lanoline, and montanate waxes.

The melting temperature of the release agent may be 50° C. or more and 110° C. or less, preferably 60° C. or more and 100° C. or less.

The melting temperature of the release agent is the "peak melting temperature" of the agent as in the methods for determining melting temperatures set forth in JIS K7121: 1987 "Testing Methods for Transition Temperatures of Plastics" and is determined from the DSC curve of the agent, which is measured by differential scanning calorimetry (DSC).

The release agent content may be 1% by mass or more and 20% by mass or less of the toner particles as a whole. Preferably, the release agent content is 5% by mass or more and 15% by mass or less.

Other Additives

Examples of other additives include well-known additives, such as magnetic substances, charge control agents, and inorganic powders. Such additives, if used, are contained in the toner particles as internal additives.

Form of Domains of the Crystalline Resin in the Toner Particles

If the toner particles contain an amorphous resin and a crystalline resin as binder resins, the toner according to this exemplary embodiment for developing an electrostatic charge image may be configured such that in a cross-sectional observation of the toner particles, at least two (preferably at least three) domains of the crystalline resin meet conditions (A), (B1)/(B2), (C), and (D). For conditions (B1) and (B2), the at least two domains of the crystalline resin only need to meet at least one of them.

Condition (A): Each domain of the crystalline resin has an aspect ratio of 5 or more and 40 or less.

Condition (B1): Each domain of the crystalline resin measures 0.5 μm or more and 1.5 μm or less along its major axis.

Condition (B2): Each domain of the crystalline resin measures, along its major axis, 10% or more and 30% or less of the longest diameter of the toner particle.

Condition (C): A line extended from the major axis of each domain of the crystalline resin makes an angle of 60° or more and 90° or less with the tangent to the surface of the toner particle at the point of contact between the extended line and the surface.

Condition (D): Lines extended from the major axis of the two domains of the crystalline resin cross each other at an angle of 45° or more and 90° or less.

Images formed with much toner thereon can be uneven in gloss. A toner according to this exemplary embodiment in this configuration may help address this, presumably for the following reasons.

If a cross-section of a toner particle has at least two domains of the crystalline resin that meet conditions (A), (B1), (C), and (D), the toner particle tends to conduct heat nearly uniformly. When an image formed by a toner containing such toner particles is fixed, therefore, it may be unlikely that the toner particles melt unevenly.

Figure 3:
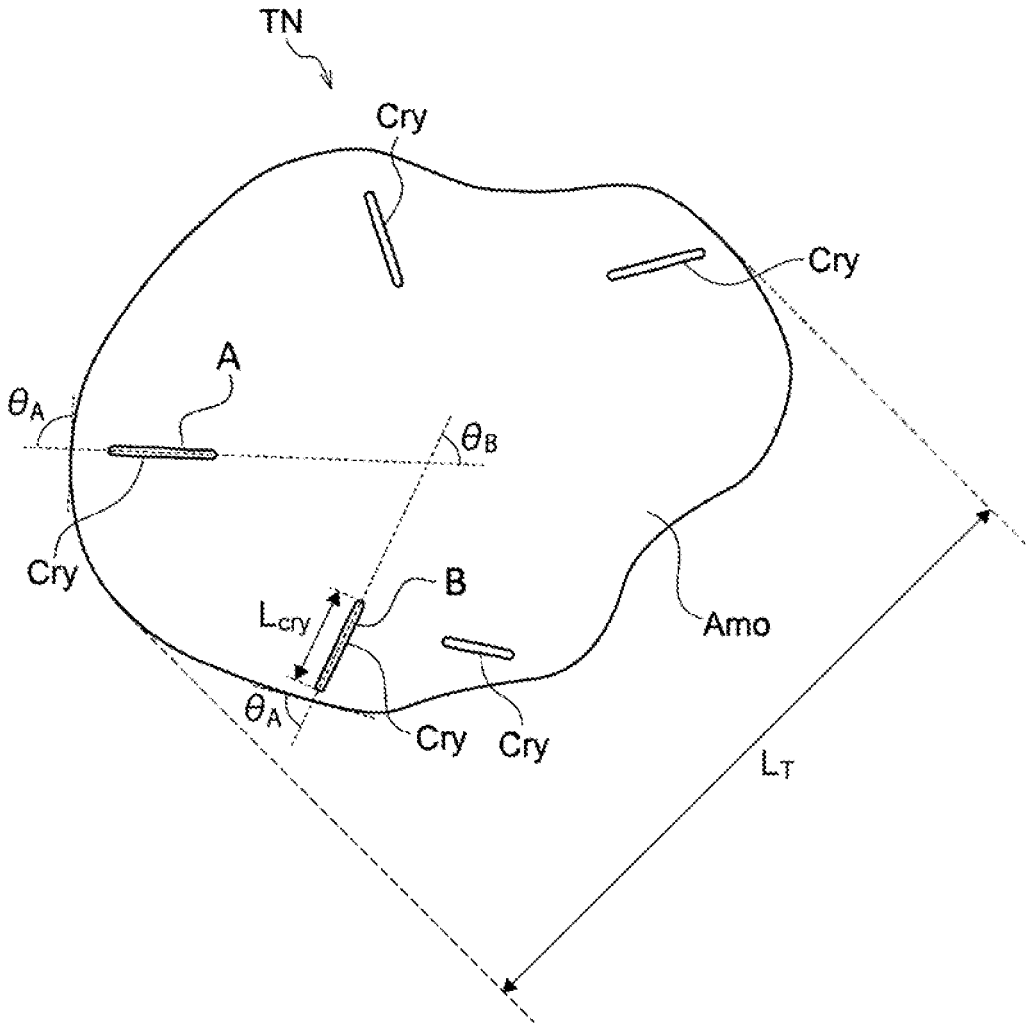
FIG. 3 is a schematic view of a cross-section of a toner particle in a toner according to an exemplary embodiment for developing an electrostatic charge image.

The situation in which a toner particle meets these conditions translates into that two domains of the crystalline resin having a large aspect ratio, i.e., ellipsoidal or needle-shaped and long along their major axis, extend from near the surface to the inside of the toner particle and cross each other (see FIG. 3).

When an image formed by a toner containing such toner particles is fixed, the ellipsoidal or needle-shaped domains of the crystalline resin melt in response to the heat applied to the toner particles, helping the heat penetrate from the surface to the inside of the toner particles quickly. As a result, the heat may spread throughout the inside of the toner particles nearly uniformly, and the toner particles may be encouraged to melt nearly evenly throughout the inside thereof.

Likewise, if a cross-section of a toner particle has at least two domains of the crystalline resin that meet conditions (A), (B2), (C), and (D), the toner particle tends to conduct heat nearly uniformly. When an image formed by a toner containing such toner particles is fixed, therefore, it may be unlikely that the toner particles melt unevenly.

The situation in which a toner particle meets these conditions translates into that two domains of the crystalline resin having a large aspect ratio, i.e., ellipsoidal or needle-shaped and long along their major axis, extend from near the surface to the inside of the toner particle and cross each other (see FIG. 3). When an image formed by a toner containing such toner particles is fixed, therefore, the heat applied to the toner particles may spread throughout the inside of the toner particles nearly uniformly, and the toner particles may be encouraged to melt nearly evenly throughout the inside thereof.

Presumably for these reasons, a toner according to this exemplary embodiment in the above configuration may help address the problem of uneven image gloss that can occur when an image is formed with much toner thereon.

The meanings of the symbols in FIG. 3 are as follows.

TN: Toner particle

Amo: Amorphous resin

Cry: Domains of the crystalline resin $L_{cry}$: Length of the domain of the crystalline resin along its major axis $L_T$: Longest diameter of the toner particle $\theta_A$: Angle between a line extended from the major axis of the domain of the crystalline resin and the tangent to the surface of the toner particle at the point of contact between the extended line and the surface $\theta_B$: Angle between lines extended from the major axis of two domains of the crystalline resin The following describes the individual conditions.

Condition (A)

Each domain of the crystalline resin has an aspect ratio of 5 or more and 40 or less.

In view of better control of unevenness in the gloss of the image, the aspect ratio of each domain of the crystalline resin may be 10 or more and 40 or less.

In this context, the aspect ratio of a domain of the crystalline resin is the ratio between the lengths of the domain of the crystalline resin along its major and minor axes (length along the major axis/length along the minor axis).

The length of a domain of the crystalline resin along its major axis is the longest length of the domain of the crystalline resin.

The length of a domain of the crystalline resin along its minor axis is the longest length of the domain of the crystalline resin in the direction perpendicular to a line extended from the major axis of the domain.

Condition (B1)

Each domain of the crystalline resin measures 0.5 μm or more and 1.5 μm or less along its major axis (see $L_{cry}$ in FIG. 3).

The length of each domain of the crystalline resin along its major axis may be 0.8 μm or more and 1.5 μm or less. This may also lead to better control of unevenness in the gloss of the image.

Condition (B2)

At least one of the two domains of the crystalline resin measures, along its major axis (see $L_{cry}$ in FIG. 3), 10% or more and 30% or less of the longest diameter of the toner particle (see $L_T$ in FIG. 3).

The percentage of the length of the domain(s) of the crystalline resin along its major axis to the longest diameter of the toner particle may be 13% or more and 30% or less, preferably 17% or more and 30% or less. This may also lead to better control of unevenness in the gloss of the image.

The longest diameter of a toner particle is the longest possible length of a segment between two points on the contour of a cross-section of the toner particle (so-called major diameter).

Condition (C)

A line extended from the major axis of each domain of the crystalline resin makes an angle of 60° or more and 90° or less with the tangent to the surface of the toner particle (i.e., the outer edge of the toner particle) at the point of contact between the extended line and the surface (see $\theta_A$ in FIG. 3).

The angle between a line extended from the major axis of each domain of the crystalline resin and the tangent to the surface of the toner particle at the point of contact between the extended line and the surface may be 75° or more and 90° or less. This may also lead to better control of unevenness in the gloss of the image.

Condition (D)

Lines extended from the major axis of the two domains of the crystalline resin cross each other at an angle of 45° or more and 90° or less (see $\theta_B$ in FIG. 3).

The angle between lines extended from the major axis of the two domains of the crystalline resin (see $\theta_B$ in FIG. 3) may be 60° or more and 90° or less. This may also lead to better control of unevenness in the gloss of the image.

The toner particles meeting these conditions may constitute 40% by number or more of all toner particles. This may also lead to better control of unevenness in the gloss of the image. Preferably, the percentage of toner particles meeting the above conditions is 70% by number or more, more preferably 80% by number or more, even more preferably 90% by number or more. It would be ideal if 100% by number of the toner particles would meet the above conditions.

With increasing percentage of toner particles meeting the above conditions, the toner particles as a whole may become more likely to melt nearly uniformly, and unevenness in the gloss of the image may be controlled better.

It should be noted that a toner particle may have three or more domains of the crystalline resin that meet conditions (A), (B1), and (C) or conditions (A), (B2), and (C). In that case, this toner particle is considered to meet the above conditions if any two of the domains of the crystalline resin meet condition (D).

Cross-Sectional Observation of Toner Particles

Whether a toner particle meets conditions (A), (B1)/(B2), (C), and (D) can be determined by observing a cross-section of the toner particle as follows.

The toner particles (with adhering external additives thereon) are mixed into epoxy resin, and the epoxy resin is cured. The resulting solid is sliced using an ultramicrotome (Leica Ultracut UCT) to give a thin specimen having a thickness of 80 nm or more and 130 nm or less. The specimen is stained with ruthenium tetroxide for 3 hours in a desiccator at 30° C. A STEM image (magnification, 20,000) of the stained specimen is obtained through transmission imaging using an ultrahigh-resolution field-emission scanning electron microscope (FE-SEM; Hitachi High-Technologies S-4800).

Then domains in a toner particle are examined to identify, by contrast and shape, whether each of them is a domain of the crystalline resin or some other resin (amorphous resin, release agent (if used), etc.). In the SEM image, the binder resins, which are rich in double bonds compared with the release agent, appear stained darker with ruthenium tetroxide. Likewise, the amorphous resin appears stained darker than the crystalline resin. By using this, one can distinguish between domains of the release agent and other resins and between domains of the crystalline and amorphous resins.

To be more specific, domains of the release agent are stained the lightest with ruthenium, domains of the crystalline resin (e.g., crystalline polyester resin) the second lightest, and domains of the amorphous resin (e.g., amorphous polyester resin) are stained the darkest. The contrast may be adjusted to make domains of the release agent look white, domains of the amorphous resin look black, and domains of the crystalline resin look light gray. Now each domain can be identified by color.

The ruthenium-stained domains of the crystalline resin are then examined to determine whether or not the toner particle meets conditions (A), (B1)/(B2), (C), and (D).

To determine the percentage of toner particles meeting the conditions, the above observation is made on 100 toner particles. Then the percentage of toner particles meeting the conditions is determined by calculation.

It should be noted that the SEM image usually includes different sizes of cross-sections of toner particles. The observations are made on cross-sections whose diameter is 85% or more of the volume-average diameter of the toner particles. The diameter of a cross-section of a toner particle in this context is the longest possible length of a segment between two points on the contour of the cross-section of a toner particle (so-called major diameter).

In a cross-section of a toner particle in which at least two domains of the crystalline resin meet condition (A), at least one of conditions (B1) and (B2), condition (C), and condition (D), furthermore, the domains of the release agent, if used, may be at 50 nm or deeper inside from the surface of the toner particle. In other words, when a cross-section of a toner particle meeting the above conditions is observed, the shortest distance between the domains of the release agent in the toner particle and the surface (outer edge) of the toner particle may be 50 nm or more.

The situation in which the domains of the release agent are at 50 nm or deeper inside from the surface of the toner particle means that no domain of the release agent is exposed on the surface of the toner particle. If there is any exposed domain of the release agent on the surface of a toner particle, the external additives adhere and concentrate preferentially where the release agent is exposed. Ensuring the domains of the release agent are at 50 nm or deeper inside from the surface of the toner particles therefore encourages the external additives to adhere to the toner particles nearly uniformly, hence a lower likelihood of uneven melting of the toner particles during fixation. As a result, unevenness in the gloss of the image may be controlled even better.

Whether a toner particle has the domains of the release agent at 50 nm or deeper inside from the surface thereof can be checked by observing a cross-section of the toner particle by the method described above.

For those toner particles that have at least two domains of the crystalline resin meeting the above conditions and have the domains of the release agent at 50 nm or deeper inside from the surface thereof, too, the percentage may be 40% by number or more of all toner particles. This may also lead to better control of unevenness in the gloss of the image. Preferably, the percentage of such toner particles is 70% by number or more, more preferably 80% by number or more, even more preferably 90% by number or more. It would be ideal if 100% by number of the toner particles would be such.

Characteristics and Other Details of the Toner Particles

The toner particles may be single-layer toner particles or may be so-called core-shell toner particles, i.e., toner particles formed by a core section (core particle) and a coating layer that covers the core section (shell layer).

Core-shell toner particles may be formed by, for example, a core section made with the binder resin and optionally additives, such as a coloring agent and a release agent, and a coating layer made with the binder resin.

The volume-average diameter (D50v) of the toner particles may be 2 μm or more and 15 μm or less, preferably 4 μm or more and 8 μm or less, more preferably 4 μm or more and 7 μm or less, even more preferably 5 μm or more and 6.5 μm or less.

It should be noted that the average diameters and geometric standard deviations of toner particles indicated herein are those measured using Coulter Multisizer II (Beckman Coulter) and ISOTON-II electrolyte (Beckman Coulter).

For measurement, a sample of the toner particles weighing 0.5 mg or more and 50 mg or less is added to 2 ml of a 5% aqueous solution of a dispersing surfactant (e.g., a sodium alkylbenzene sulfonate). The resulting dispersion is added to 100 ml or more and 150 ml or less of the electrolyte.

The electrolyte with a suspended sample therein is sonicated for 1 minute using a sonicator, and size distribution is measured on 50000 sampled particles within a diameter range of 2 μm to 60 μm using Coulter Multisizer II with an aperture size of 100 μm.

The measured distribution is divided into segments by particle size (channels), and the cumulative distribution of volume and that of frequency are plotted starting from the smallest diameter. The particle diameter at which the cumulative volume is 16% and that at which the cumulative frequency is 16% are defined as volume diameter D16v and number diameter D16p, respectively, of the toner particles. The particle diameter at which the cumulative volume is 50% and that at which the cumulative frequency is 50% are defined as the volume-average diameter D50v and cumulative number-average diameter D50p, respectively, of the toner particles. The particle diameter at which the cumulative volume is 84% and that at which the cumulative frequency is 84% are defined as volume diameter D84v and number diameter D84p, respectively, of the toner particles.

These are used to calculate the geometric standard deviation by volume (GSDv) and geometric standard deviation by number (GSDp). GSDv is given by $(D84v/D16v)^{1/2}$, and GSDp is given by $(D84p/D16p)^{1/2}$.

The average roundness of the toner particles may be 0.94 or more and 1.00 or less, preferably 0.95 or more and 0.98 or less.

The average roundness of the toner particles is given by (circumference of the equivalent circle)/(circumference) [(circumference of circles having the same projected area as particle images)/(circumference of projected images of the particles)]. Specifically, the average roundness of the toner particles can be measured as follows.

First, a portion of the toner particles of interest is collected by aspiration in such a manner that it will form a flat stream. This flat stream is photographed with a flash to capture the figures of the particles in a still image. The images of 3500 sampled particles are analyzed using a flow particle-image analyzer (Sysmex FPIA-3000), and the average roundness is determined from the results.

The toner according to this exemplary embodiment contains external additives. Prior to these measurements, therefore, the toner particles are isolated by removing the external additives. The external additives can be removed by dispersing the toner in water containing a surfactant and sonicating the resulting dispersion.

Characteristics of the Toner

When the toner according to this exemplary embodiment is analyzed with a differential scanning calorimeter (DSC), the largest endothermic peak in the first run of heating may appear at a temperature of 58° C. or more and 75° C. or less. The toner may fix well at low temperatures when it has its largest endothermic peak in the first heating run between 58° C. to 75° C.

The DSC analysis of the toner and the measurement of the temperature at which the toner has its largest endothermic peak in the first run of heating can be as follows.

The measuring instrument is PerkinElmer's DSC-7 differential scanning calorimeter. The detector of the calorimeter is calibrated for temperature by measuring the melting point of indium and zinc and for enthalpy by measuring the melting enthalpy of indium. An aluminum pan with a sample therein and a control empty pan are heated from room temperature to 150° C. at a rate of 10° C./min. The resulting endothermic curve is examined to find the temperature at which the curve has the largest endothermic peak.

Production of the Toner

The following describes the production of a toner according to this exemplary embodiment.

A toner according to this exemplary embodiment can be obtained by producing the toner particles and then adding the external additives to the toner particles.

The production of the toner particles can be by a dry process (e.g., kneading and milling) or wet process (e.g., aggregation and coalescence, suspension polymerization, or dissolution and suspension). Any well-known dry or wet process may be used to produce the toner particles.

Preferably, the toner particles are obtained by aggregation and coalescence. This may help ensure that domains of a crystalline resin meet the aforementioned conditions.

Specifically, if the toner particles are produced by, for example, aggregation and coalescence, the production process can be as follows.

A liquid dispersion of amorphous-resin particles, in which particles of an amorphous resin have been dispersed, and a liquid dispersion of crystalline-resin particles, in which particles of a crystalline resin have been dispersed, are prepared (preparation of liquid dispersions of resin particles).

The particles of an amorphous resin (optionally with a coloring agent, a release agent, etc.) are allowed to aggregate in the liquid dispersion of amorphous-resin particles (optionally after liquid dispersions of a coloring agent, a release agent, etc., are mixed therein). This gives first aggregates (formation of first aggregates).

The resulting liquid dispersion of first aggregates is mixed with the liquid dispersion of amorphous-resin particles and the liquid dispersion of crystalline-resin particles (or with a mixture of the liquid dispersion of amorphous-resin particles and the liquid dispersion of crystalline-resin particles), and the particles of amorphous and crystalline resins in the mixture are allowed to aggregate on the surface of the first aggregates. This is repeated twice or more to give second aggregates (formation of second aggregates).

The resulting liquid dispersion of second aggregates is mixed with the liquid dispersion of amorphous-resin particles, and the particles of an amorphous resin in the mixture are allowed to aggregate on the surface of the second aggregates. This gives third aggregates (formation of third aggregates).

The resulting liquid dispersion of third aggregates is heated to make the aggregates fuse and coalesce together and form toner particles (fusion and coalescence).

The following describes this process in detail.

It should be noted that the process described below gives toner particles that contain a coloring agent and a release agent, but the use of coloring and release agents is optional. Naturally, other additives may also be used.

Preparation of Liquid Dispersions of Resin Particles

First, liquid dispersions of resin particles, in each of which particles of a binder resin have been dispersed (a liquid dispersion of amorphous-resin particles and a liquid dispersion of crystalline-resin particles), are prepared. A liquid dispersion of coloring-agent particles and a liquid dispersion of release-agent particles, for example, are also prepared.

The preparation of each liquid dispersion of resin particles can be by, for example, producing it by dispersing the resin particles in a dispersion medium using a surfactant.

An example of a dispersion medium for the liquid dispersions of resin particles is an aqueous medium.

Examples of aqueous media include types of water, such as distilled water and deionized water, and alcohols. One such dispersion medium may be used alone, or two or more may be used in combination.

Examples of surfactants include anionic surfactants, such as sulfates, sulfonates, phosphates, and soap surfactants; cationic surfactants, such as amine salts and quaternary ammonium salts; and nonionic surfactants, such as polyethylene glycol surfactants, ethylene oxide adducts of alkylphenols, and polyhydric alcohols. In particular, anionic surfactants and cationic surfactants are typical examples. A combination of a nonionic surfactant with an anionic or cationic surfactant may also be used.

One surfactant may be used alone, or two or more may be used in combination.

In the production of the liquid dispersions of resin particles, the dispersion of the resin particles in the dispersion medium can be by a commonly used dispersion technique, such as the use of a rotary-shear homogenizer or a ball mill, sand mill, Dyno-Mill, or other medium mill. For certain types of resin particles, phase inversion emulsification, for instance, may work.

In phase inversion emulsification, the resin to be dispersed is first dissolved in a hydrophobic organic solvent in which the resin is soluble. The resulting organic continuous phase (O phase) is neutralized with a base, and then an aqueous medium (W phase) is added. This converts the resin emulsion from the W/O to O/W form (so-called phase inversion) and creates a discontinuous phase of the resin, thereby dispersing particles of the resin in the aqueous medium.

The volume-average diameter of the resin particles to be dispersed in each liquid dispersion may be, for example, 0.01 μm or more and 1 μm or less, preferably 0.08 μm or more and 0.8 μm or less, more preferably 0.1 μm or more and 0.6 μm or less.

The volume-average diameter of resin particles can be measured as follows. That is, the size distribution of the particles is measured using a laser-diffraction particle size distribution analyzer (e.g., HORIBA LA-700). The measured distribution is divided into segments by particle size (channels), and the cumulative distribution of volume is plotted starting from the smallest diameter. The particle diameter at which the cumulative volume is 50% of the total volume of the particles is the volume-average diameter D50v of the particles. For the other liquid dispersions, too, the volume-average diameter of particles therein can be measured in the same way.

The resin particle content of each liquid dispersion of resin particles may be, for example, 5% by mass or more and 50% by mass or less, preferably 10% by mass or more and 40% by mass or less.

The liquid dispersion of coloring-agent particles and the liquid dispersion of release-agent particles, for example, are also produced in the same way as the liquid dispersions of resin particles. That is, what is described about the volume-average diameter of particles, dispersion medium, how to disperse the particles, and the particle content in relation to the liquid dispersions of resin particles also applies to the particles of a coloring agent and the particles of a release agent in their respective liquid dispersions.

Formation of First Aggregates

Then the liquid dispersion of amorphous-resin particles is mixed with the liquid dispersion of coloring-agent particles and the liquid dispersion of release-agent particles.

In the resulting mixture of liquid dispersions, the particles of an amorphous resin, a coloring agent, and a release agent are allowed to aggregate together. This process of hetero-aggregation is continued until aggregates including particles of an amorphous resin, a coloring agent, and a release agent (first aggregates) grow to a diameter close to the planned diameter of the toner particles.

Specifically, for example, a flocculant is added to the mixture of liquid dispersions, and the pH of the mixture is adjusted to an acidic level (e.g., a pH of 2 or more and 5 or less). A dispersion stabilizer may optionally be added. The mixture of liquid dispersions is then heated to a temperature near the glass transition temperature of the resin particles (specifically, for example, a temperature higher than or equal to the glass transition temperature the resin particles minus 30° C. but not higher than the glass transition temperature of the resin particles minus 10° C.) making the particles dispersed in the mixture form aggregates (first aggregates).

In the formation of first aggregates, the addition of the flocculant may be carried out, for example, at room temperature (e.g., 25° C.) with the mixture of liquid dispersions stirred using a rotary-shear homogenizer. Then the pH of the mixture is adjusted to an acidic level (e.g., a pH of 2 or more and 5 or less), optionally followed by the addition of a dispersion stabilizer, and the mixture is heated as described above.

Examples of flocculants include surfactants that have the opposite polarity to the dispersing surfactant that has been added to the mixture of liquid dispersions, inorganic metal salts, and metal complexes having a valency of 2 or more. Using a metal complex may help improve charging characteristics because in that case less surfactant is used.

Optionally, an additive that forms a complex or similar bond with metal ions from the flocculant may be used. An example is a chelating agent.

Examples of inorganic metal salts include metal salts such as calcium chloride, calcium nitrate, barium chloride, magnesium chloride, zinc chloride, aluminum chloride, and aluminum sulfate and also include polymers of inorganic metal salts, such as polyaluminum chloride, polyaluminum hydroxide, and calcium polysulfide.

Using a magnesium salt may be an easy way to ensure that the finished toner will contain the Mg element. Preferably, the flocculant is magnesium chloride.

The chelating agent, if used, may be a water-soluble one. Examples of chelating agents include oxycarboxylic acids, such as tartaric acid, citric acid, and gluconic acid, iminodiacetic acid (IDA), nitrilotriacetic acid (NTA), and ethylenediaminetetraacetic acid (EDTA).

The amount of chelating agent added may be, for example, 0.01 parts by mass or more and 5.0 parts by mass or less, preferably 0.1 parts by mass or more and less than 3.0 parts by mass, per 100 parts by mass of the particles of an amorphous resin.

Formation of Second Aggregates

The resulting liquid dispersion of first aggregates is mixed with the liquid dispersion of amorphous-resin particles and the liquid dispersion of crystalline-resin particles. Alternatively, the liquid dispersion of first aggregates may be mixed with a mixture of the liquid dispersion of amorphous-resin particles and the liquid dispersion of crystalline-resin particles.

In the resulting mixture, in which first aggregates have been dispersed together with particles of amorphous and crystalline resins, the particles of amorphous and crystalline resins are allowed to aggregate on the surface of the first aggregates.

Specifically, for example, the liquid dispersion of first aggregates in which first aggregates have grown to a certain diameter is combined with the liquid dispersion of amorphous-resin particles and the liquid dispersion of crystalline-resin particles. The resulting mixture is heated at a temperature equal to or lower than the glass transition temperature of the particles of an amorphous resin.

This process of inducing aggregation is repeated twice or more. The resulting aggregates are second aggregates. Formation of Third Aggregates The resulting liquid dispersion of second aggregates is mixed with the liquid dispersion of amorphous-resin particles.

In the resulting mixture, in which second aggregates have been dispersed together with particles of an amorphous resin, the particles of an amorphous resin are allowed to aggregate on the surface of the second aggregates.

Specifically, for example, the liquid dispersion of second aggregates in which second aggregates have grown to a certain diameter is combined with the liquid dispersion of amorphous-resin particles. The resulting mixture is heated at a temperature equal to or lower than the glass transition temperature of the particles of an amorphous resin.

Then the pH of the liquid dispersion is adjusted to terminate aggregation.

Fusion and Coalescence

The resulting liquid dispersion of third aggregates is heated, for example to a temperature equal to or higher than the glass transition temperature of the particles of an amorphous resin (e.g., to at least 10° C. to 30° C. higher than the glass transition temperature of the particles of an amorphous resin). This causes the aggregates to fuse and coalesce together and form toner particles.

After the heat-induced fusion and coalescence, the aggregates may be, for example, cooled to 30° C. at a rate of 5° C./min or more and 40° C./min or less. Rapid cooling after the second aggregation promotes surface shrinkage, and therefore surface cracking, of the toner particles. It appears that rapid cooling under the above conditions forces the toner particles to crack in the direction from inside toward the surface.

Then the aggregates are heated again at a rate of 0.1° C./min or more and 2° C./min or less and kept at a temperature equal to or higher than the melting temperature of the crystalline resin minus 5° C. for at least 10 minutes. Then the aggregates are cooled slowly, at a rate of 0.1° C./min or more and 1° C./min or less. This causes domains of the crystalline resin to grow along the cracks, from the inside to the surface of the toner particles, ensuring that the toner particles will have domains of a crystalline resin meeting the aforementioned conditions.

In addition, heating the rapidly cooled aggregates to a temperature equal to or higher than the melting temperature of the release agent, for example, often causes domains of the release agent to grow to near the surface of the toner particles. After rapid cooling, therefore, the aggregates may be heated to a temperature equal to or higher than the melting temperature of the crystalline resin minus 5° C. but not higher than the melting temperature of the release agent.

In this way, the toner particles are obtained.

After the end of fusion and coalescence, the toner particles, formed in a solution, are washed, separated from the solution, and dried by known methods to give dry toner particles.

The washing can be by sufficient replacement with deionized water in view of chargeability. The separation from the solution can be by any method, but techniques such as suction filtration and pressure filtration may help increase productivity. The drying, too, can be by any method, but techniques such as lyophilization, flash drying, fluidized drying, and vibrating fluidized drying may help increase productivity.

Then a toner according to this exemplary embodiment is produced, for example by mixing the dry toner particles with added external additives including particles of at least one compound represented by formula (1) and particles of a metal salt of a fatty acid, both as described above. The mixing can be through the use of, for example, a V-blender, Henschel mixer, or Lodige mixer. Optionally, coarse particles may be removed from the toner, for example using a vibrating sieve or air-jet sieve.

Electrostatic Charge Image Developer

An electrostatic charge image developer according to an exemplary embodiment contains at least a toner according to the above exemplary embodiment.

The electrostatic charge image developer according to this exemplary embodiment may be a one-component developer, which is substantially a toner according to an exemplary embodiment, or may be a two-component developer, which is a mixture of the toner and a carrier.

The carrier can be of any known type. Examples include coated carriers, formed by a magnetic powder as a core material and a coating resin with which the surface of the core material is coated; magnetic powder-dispersed carriers, formed by a matrix resin and a magnetic powder dispersed or mixed therein; and resin-impregnated carriers, formed by a porous magnetic powder and resin spread inside the magnetic powder.

Particles of a magnetic powder-dispersed or resin-impregnated carrier may serve as a core material; these types of carriers may be used with a resin coating thereon.

Examples of magnetic powders include a powder of a magnetic metal, such as iron, nickel, or cobalt, and a powder of a magnetic oxide, such as ferrite or magnetite.

Examples of resins, for use as a coating or matrix, include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins, which have organosiloxane bonds, and their modified forms, fluoropolymers, polyester, polycarbonate, phenolic resins, and epoxy resins.

Resins containing additives, such as electrically conductive particles, may also be used.

Examples of electrically conductive particles include particles of gold, silver, copper, or some other metal, carbon black, titanium oxide, zinc oxide, tin oxide, barium sulfate, aluminum borate, and potassium titanate.

The coating of the surface of the core material with a coating resin can be by, for example, dissolving the coating resin in a solvent, optionally with additives, and form a coating layer with the resulting solution (solution for forming a coating layer). The solvent can be of any kind and is selected considering, for example, the coating resin used and suitability for coating.

Specific examples of techniques that can be used for this resin coating include dipping, i.e., immersing the core material in the solution for forming a coating layer; spraying, i.e., applying a mist of the solution for forming a coating layer onto the surface of the core material; fluidized bed coating, i.e., applying a mist of the solution for forming a coating layer with the core material floated on a stream of air; and kneader-coater coating, i.e., mixing the core material for the carrier and the solution for forming a coating layer in a kneader-coater and then removing the solvent.

In the case of a two-component developer, the mix ratio (by mass) between the toner and the carrier may be between 1:100 (toner:carrier) and 30:100, preferably between 3:100 and 20:100.

Image Forming Apparatus/Image Forming Method

The following describes an image forming apparatus/image forming method according to an exemplary embodiment.

An image forming apparatus according to this exemplary embodiment includes an image carrier; a charging component that charges the surface of the image carrier; an electrostatic charge image creating component that creates an electrostatic charge image on the charged surface of the image carrier; a developing component that contains an electrostatic charge image developer and develops, using the electrostatic charge image developer, the electrostatic charge image on the surface of the image carrier to form a toner image; a transfer component that transfers the toner image on the surface of the image carrier to the surface of a recording medium; and a fixing component that fixes the toner image on the surface of the recording medium. The electrostatic charge image developer is an electrostatic charge developer according to the above exemplary embodiment.

The image forming apparatus according to this exemplary embodiment performs an image forming method (image forming method according to an exemplary embodiment) that includes charging the surface of an image carrier; creating an electrostatic charge image on the charged surface of the image carrier; developing, using an electrostatic charge image developer according to the above exemplary embodiment, the electrostatic charge image on the surface of the image carrier to form a toner image; transferring the toner image on the surface of the image carrier to the surface of a recording medium; and fixing the toner image on the surface of the recording medium.

The configuration of the image forming apparatus according to this exemplary embodiment can be applied to well-known types of image forming apparatuses, including direct-transfer apparatuses, which transfer a toner image formed on the surface of an image carrier directly to a recording medium; intermediate-transfer apparatuses, which transfer a toner image formed on the surface of an image carrier to the surface of an intermediate transfer body (first transfer) and then transfer the toner image on the surface of the intermediate transfer body to the surface of a recording medium (second transfer); apparatuses having a cleaning component that cleans the surface of the image carrier between the transfer of the toner image and charging; and apparatuses having a static eliminator that removes static electricity from the surface of the image carrier by irradiating the surface with antistatic light between the transfer of the toner image and charging.

Image forming apparatuses having a cleaning component that cleans the surface of the image carrier may be particularly suitable. An example of a cleaning component is a cleaning blade.

The transfer component of an intermediate-transfer apparatus may have, for example, an intermediate transfer body, a first transfer component, and a second transfer component. The toner image formed on the surface of the image carrier is transferred to the surface of the intermediate transfer body by the first transfer component (first transfer), and then the toner image on the surface of the intermediate transfer body is transferred to the surface of a recording medium by the second transfer component (second transfer).

Part of the image forming apparatus according to this exemplary embodiment, e.g., a portion including the developing component, may have a cartridge structure, i.e., a structure that allows the part to be detached from and attached again to the image forming apparatus (or may be a process cartridge). An example of a process cartridge is one that includes a developing component that contains an electrostatic charge image developer according to the above exemplary embodiment.

The following describes an example of an image forming apparatus according to this exemplary embodiment. It is to be understood that this example is not the only possible form of the apparatus. The following describes some of its structural elements with reference to a drawing.

FIG. 1 is a schematic view of the structure of an image forming apparatus according to this exemplary embodiment.

The image forming apparatus illustrated in FIG. 1 includes first to fourth electrophotographic image forming units 10Y, 10M, 10C, and 10K (image forming component) that produce images in the colors of yellow (Y), magenta (M), cyan (C), and black (K), respectively, based on color-separated image data. These image forming units (hereinafter also referred to simply as "units") 10Y, 10M, 10C, and 10K are arranged in a horizontal row with a predetermined distance therebetween. The units 10Y, 10M, 10C, and 10K may be process cartridges, i.e., units that can be detached from and attached again to the image forming apparatus.

Above the units 10Y, 10M, 10C, and 10K in the drawing, an intermediate transfer belt 20 as an intermediate transfer body extends to pass through each of the units. There are a drive roller 22 (right in the drawing) and a support roller 24 (left in the drawing) spaced apart from each other, and the intermediate transfer belt 20 is wound over these two rollers, with the rollers touching the inner surface of the intermediate transfer belt 20, and is driven by them to run in the direction from the first unit 10Y to the fourth unit 10K. The support roller 24 is forced by a spring or similar mechanism, not illustrated in the drawing, to go away from the drive roller 22, thereby placing tension on the intermediate transfer belt 20 wound over the two rollers. On the image-carrying side of the intermediate transfer belt 20 is a cleaning device 30 for the intermediate transfer belt 20 facing the drive roller 22.

The units 10Y, 10M, 10C, and 10K, moreover, have developing devices (developing component) 4Y, 4M, 4C, and 4K, to which toners including those in the four colors of yellow, magenta, cyan, and black, respectively, are delivered from toner cartridges 8Y, 8M, 8C, and 8K.

The first to fourth units 10Y, 10M, 10C, and 10K are equivalent in structure. In the following, the first unit 10Y, located upstream of the others in the direction of running of the intermediate transfer belt 20 and forms a yellow image, is described to represent the four units. The second to fourth units 10M, 10C, and 10K have structural elements equivalent to those of the first unit 10Y, and these elements are designated with the same numerals as in the first unit 10Y but with the letters M (for magenta), C (for cyan), and K (for black), respectively, in place of Y (for yellow).

The first unit 10Y has a photoreceptor 1Y that acts as an image carrier. Around the photoreceptor 1Y are a charging roller (example of a charging component) 2Y that charges the surface of the photoreceptor 1Y to a predetermined potential; an exposure device (example of an electrostatic charge image creating component) 3 that irradiates the charged surface with a laser beam 3Y produced on the basis of a color-separated image signal to create an electrostatic charge image there; a developing device (example of a developing component) 4Y that supplies charged toner to the electrostatic charge image to develop the electrostatic charge image; a first transfer roller (example of a first transfer component) 5Y that transfers the developed toner image to the intermediate transfer belt 20; and a photoreceptor cleaning device (example of a cleaning component) 6Y that removes residual toner off the surface of the photoreceptor 1Y after the first transfer, arranged in this order.

The first transfer roller 5Y is inside the intermediate transfer belt 20 and faces the photoreceptor 1Y. Each of the first transfer rollers 5Y, 5M, 5C, and 5K, moreover, is connected to a bias power supply (not illustrated) that applies a first transfer bias to the roller. Each bias power supply is controlled by a controller, not illustrated in the drawing, to change the magnitude of the transfer bias it applies to the corresponding first transfer roller.

The operation of forming a yellow image at the first unit 10Y may be as described below.

Before the operation, the charging roller 2Y first charges the surface of the photoreceptor 1Y to a potential of −600 V to −800 V.

The photoreceptor 1Y is a stack of an electrically conductive substrate (e.g., having a volume resistivity at 20° C. of $1\times10^{-6}$ Ωcm or less) and a photosensitive layer thereon. The photosensitive layer is of high electrical resistance (has the typical resistance of resin) in its normal state, but when it is irradiated with a laser beam 3Y, the resistivity of the irradiated portion changes. Thus, a laser beam 3Y is emitted using the exposure device 3 onto the charged surface of the photoreceptor 1Y in accordance with data for the yellow image sent from a controller, not illustrated in the drawing. The laser beam 3Y hits the photosensitive layer on the surface of the photoreceptor 1Y, creating an electrostatic charge image as a pattern for the yellow image on the surface of the photoreceptor 1Y.

The electrostatic charge image is an image created on the surface of the photoreceptor 1Y by electrical charging and is a so-called negative latent image that is created as a result of the charge on the surface of the photoreceptor 1Y flowing away in the irradiated portion of the photosensitive layer, in which the resistivity decreases by exposure to the laser beam 3Y, and staying in the portion of the photosensitive layer not irradiated with the laser beam 3Y.

As the photoreceptor 1Y rotates, the electrostatic charge image created on the photoreceptor 1Y is moved to a predetermined development point. At this development point, the electrostatic charge image on the photoreceptor 1Y is visualized (developed) by the developing device 4Y into a toner image.

Inside the developing device 4Y is an electrostatic charge image developer that contains, for example, at least yellow toner and a carrier. The yellow toner is on a developer roller (example of a developer carrier) and has been triboelectrically charged with the same polarity as the charge on the photoreceptor 1Y (negative) as a result of being stirred inside the developing device 4Y. As the surface of the photoreceptor 1Y passes through the developing device 4Y, the yellow toner electrostatically adheres to the uncharged, latent-image portion of the surface of the photoreceptor 1Y and develops the latent image. The photoreceptor 1Y, now having a yellow toner image thereon, then continues rotating at a predetermined speed, transporting the toner image developed thereon to a predetermined first transfer point.

After the arrival of the yellow toner image on the photoreceptor 1Y at the first transfer point, a first transfer bias is applied to the first transfer roller 5Y. An electrostatic force acts on the toner image in the direction from the photoreceptor 1Y toward the first transfer roller 5Y, causing the toner image to be transferred from the photoreceptor 1Y to the intermediate transfer belt 20. The transfer bias applied here has the (+) polarity, opposite the polarity of the toner (−), and its amount is controlled by a controller (not illustrated). At the first unit 10Y, for example, it is controlled to +10 μA.

Residual toner on the photoreceptor 1Y is removed and collected at the photoreceptor cleaning device 6Y.

The first transfer biases applied to the first transfer rollers 5M, 5C, and 5K of the second, third, and fourth units 10M, 10C, and 10K are also controlled in the same way as that at the first unit 10Y.

The intermediate transfer belt 20 to which a yellow toner image has been transferred at the first unit 10Y as described above is then moved to pass through the second to fourth units 10M, 10C, and 10K sequentially. Toner images in the respective colors are overlaid, completing multilayer transfer.

The intermediate transfer belt 20 that has passed through the first to fourth units and thereby completed multilayer transfer of toner images in four colors then reaches the second transfer section. The second transfer section is formed by the intermediate transfer belt 20, the support roller 24, which touches the inner surface of the intermediate transfer belt 20, and a second transfer roller (example of a second transfer component) 26, which is on the image-carrying side of the intermediate transfer belt 20. Recording paper (example of a recording medium) P is fed to the point of contact between the second transfer roller 26 and the intermediate transfer belt 20 in a timed manner by a feeding mechanism, and a second transfer bias is applied to the support roller 24. The transfer bias applied here has the (−) polarity, the same as the polarity of the toner (−).

An electrostatic force acts on the toner image in the direction from the intermediate transfer belt 20 toward the recording paper P, causing the toner image to be transferred from the intermediate transfer belt 20 to the recording paper P. The amount of the second transfer bias has been controlled and is determined in accordance with the resistance detected by a resistance detector (not illustrated) that detects the electrical resistance of the second transfer section.

After that, the recording paper P is sent to the point of pressure contact (nip) between a pair of fixing rollers at a fixing device (example of a fixing component) 28. The toner image is fixed on the recording paper P there, giving a fixed image.

The recording paper P to which the toner image is transferred can be, for example, a piece of ordinary printing paper for copiers, printers, etc., of electrophotographic type. In addition to recording paper P, recording media such as overhead-projector (OHP) sheets may also be used.

The use of recording paper P having a smooth surface may help further improve the smoothness of the surface of the fixed image. For example, the recording paper P may be coated paper, which is paper with a coating, for example of resin, on its surface, or art paper for printing.

The recording paper P to which a color image has been fixed is transported to an ejection section to finish the formation of a color image.

Process Cartridge/Toner Cartridge

The following describes a process cartridge according to an exemplary embodiment.

A process cartridge according to this exemplary embodiment includes a developing component that contains an electrostatic charge image developer according to an above exemplary embodiment and develops, using the electrostatic charge image developer, an electrostatic charge image created on the surface of an image carrier to form a toner image. The process cartridge can be attached to and detached from an image forming apparatus.

The foregoing is not the only possible configuration of a process cartridge according to this exemplary embodiment. Besides the developing component, the process cartridge may optionally have at least one extra component selected from an image carrier, a charging component, an electrostatic charge image creating component, a transfer component, etc.

The following describes an example of a process cartridge according to this exemplary embodiment. It is to be understood that this example is not the only possible form of the process cartridge. The following describes some of its structural elements with reference to a drawing.

Figure 2:
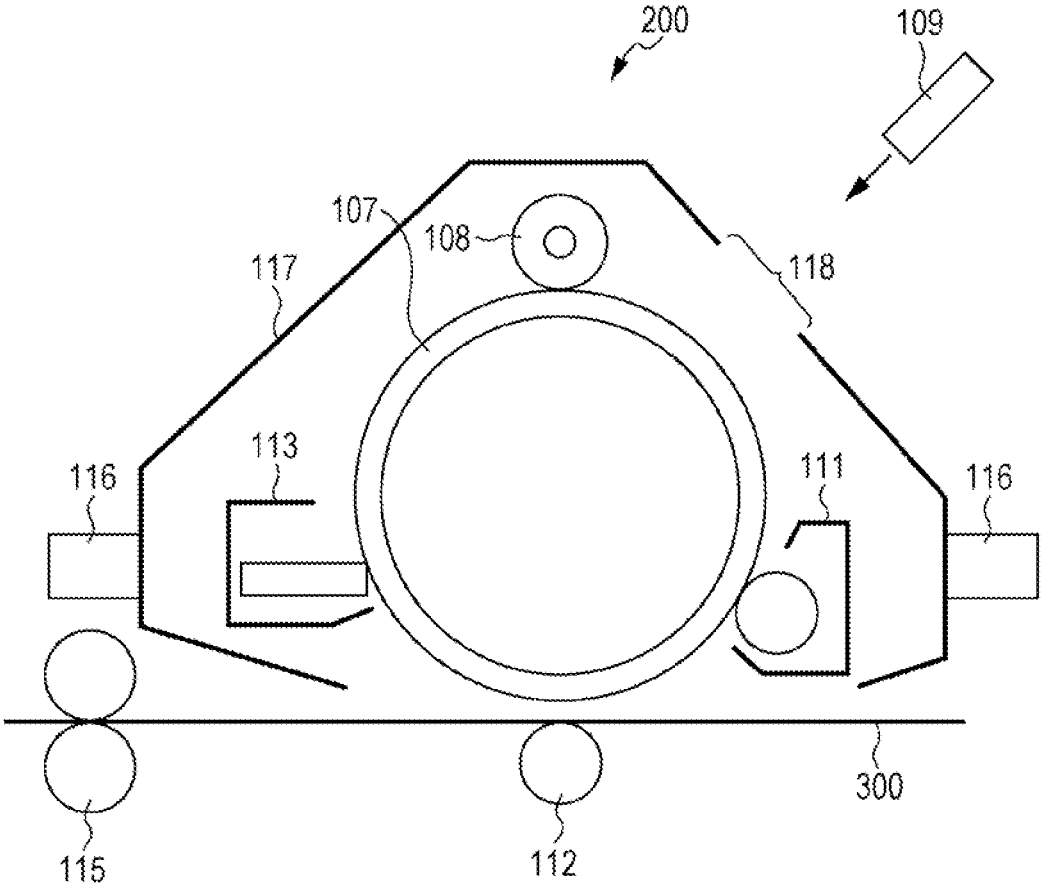
FIG. 2 is a schematic view of the structure of an example of a process cartridge according to an exemplary embodiment.

FIG. 2 is a schematic view of the structure of a process cartridge according to this exemplary embodiment.

The process cartridge 200 illustrated in FIG. 2 is a cartridge formed by, for example, a housing 117 and components held together therein. The housing 117 has attachment rails 116 and an opening 118 for exposure to light. The components inside the housing 117 include a photoreceptor 107 (example of an image carrier) and a charging roller 108 (example of a charging component), a developing device 111 (example of a developing component), and a photoreceptor cleaning device 113 (example of a cleaning component) provided around the photoreceptor 107.

FIG. 2 also illustrates an exposure device (example of an electrostatic charge image creating component) 109, a transfer device (example of a transfer component) 112, a fixing device (example of a fixing component) 115, and recording paper (example of a recording medium) 300.

The following describes a toner cartridge according to an exemplary embodiment.

A toner cartridge according to this exemplary embodiment contains a toner according to an above exemplary embodiment and can be attached to and detached from an image forming apparatus. A toner cartridge is a cartridge that stores replenishment toner for a developing component placed inside an image forming apparatus.

The image forming apparatus illustrated in FIG. 1 has been configured so that toner cartridges 8Y, 8M, 8C, and 8K can be detached from and attached again to it. The developing devices 4Y, 4M, 4C, and 4K are connected to their corresponding toner cartridges (or the toner cartridges for their respective colors) by toner feed tubing, not illustrated in the drawing. When there is little toner in a toner cartridge, this toner cartridge is replaced.

EXAMPLES

The following describes the above exemplary embodiments in more specific terms, in further detail, by providing examples and comparative examples. The above exemplary embodiments, however, are by no means limited to these Examples. "Parts" and "%" used to describe the quantity of something are by mass unless stated otherwise. Production of Calcium Titanate Particles 1 ($CaTiO_3$-1) Preparation of a Liquid Dispersion of Metatitanic Acid A liquid dispersion of metatitanic acid is desulfurized by adjusting its pH to 9.0 with a 4.0 moles/liter aqueous solution of sodium hydroxide, and the desulfurized dispersion is neutralized to a pH of 5.5 with a 6.0 moles/liter hydrochloric acid. The neutralized liquid dispersion of metatitanic acid is filtered, the residue is washed with water, and water is added to the washed cake of metatitanic acid to give a liquid dispersion containing the equivalent of 1.25 moles of titanium oxide, $TiO_2$, per liter. The pH of this liquid dispersion is adjusted to 1.2 with a 6.0 moles/liter hydrochloric acid. The aggregates of metatitanic acid in the liquid dispersion are deflocculated by stirring the dispersion at a controlled temperature of 35° C. for 1 hour.

Reaction of Calcium Titanate Particles 1

From the deflocculated dispersion of metatitanic acid, an amount of metatitanic acid equivalent to 0.156 moles of titanium oxide, $TiO_2$, is sampled into a reactor. An aqueous solution of calcium carbonate, $CaCO_3$, is then added to the reactor. The final concentration of titanium oxide in the reaction system is 0.156 moles/liter, and the calcium carbonate, $CaCO_3$, is added to make the molar ratio of calcium carbonate to titanium oxide 1.15 ($CaCO_3/TiO_2$=1.15/1.00).

The reactor is left for 20 minutes with a stream of nitrogen thereinto so that its inside is purged with nitrogen. Then the mixture inside the reactor, containing metatitanic acid and calcium carbonate, is warmed to 90° C. The pH is adjusted to 8.0 with an aqueous solution of sodium hydroxide over 14 hours, and the mixture is stirred for 1 hour at 90° C. to complete the reaction.

The inside of the reactor in which the reaction has ended is cooled to 40° C., and the supernatant is removed in a nitrogen atmosphere. The reactor is then decanted with 2,500 g of purified water twice. After the decantation, the reaction system is filtered using a Buchner funnel. The resulting cake is dried in the air for 8 hours at an elevated temperature of 110° C.

The resulting dry calcium titanate is put into an alumina crucible and dehydrated and fired at 930° C. The fired calcium titanate is put into water and wet-ground using a sand grinder to give a liquid dispersion. Excessive calcium carbonate is removed by adjusting the pH to 2.0 with a 6.0 moles/liter hydrochloric acid.

Surface-Modification of Calcium Titanate Particles 1

After the removal of excessive calcium carbonate, calcium titanate surfaces are modified under wet conditions using SM7036EX silicone oil emulsion (dimethylpolysiloxane emulsion) (Dow Corning Toray Silicone Co., Ltd.). One hundred parts by mass, on a solids basis, of calcium titanate is stirred with 1.0 part by mass of the silicone emulsion oil for 30 minutes.

The mixture containing the surface-modified titanate is neutralized to a pH of 6.5 with a 4.0 moles/liter aqueous solution of sodium hydroxide. The neutralized mixture is filtered, and the residue is washed and dried at 150° C. The dried residue is milled using a mechanical mill for 60 minutes. The resulting particles are calcium titanate particles 1.

Production of Calcium Titanate Particles 2 to 6 ($CaTiO_3$-2 to -6)

Sets of calcium titanate particles differing in diameter are produced in the same way as calcium titanate particles 1. Adjustments are made to the duration of the addition of an aqueous solution of sodium hydroxide, the pH reached thereby, and the temperature and duration of the stirring after that. The resulting sets of particles are calcium titanate particles 2 to 6.

The diameter of the particles becomes smaller with shorter duration of the addition of an aqueous solution of sodium hydroxide, lower pH reached thereby, and lower temperature and shorter duration of the stirring after that. The opposites result in larger diameters of the particles.

Production of Strontium Titanate Particles 1 ($SrTiO_3$-1)

Particles of strontium titanate are produced in the same way as calcium titanate particles 1. The calcium carbonate is changed to strontium chloride, and the strontium chloride, $SrCl_2$, is added to make the molar ratio of strontium chloride to titanium oxide 1.1 ($SrCl_2/TiO_2$=1.10/1.00). The resulting particles are strontium titanate particles 1.

Production of Barium Titanate Particles 1 ($BaTiO_3$-1)

Particles of barium titanate are produced in the same way as calcium titanate particles 1. The calcium carbonate is changed to barium chloride, and the barium chloride, $BaCl_2$, is added to make the molar ratio of barium chloride to titanium oxide 1.1 ($BaCl_2/TiO_2$=1.10/1.00). The resulting particles are barium titanate particles 1.

Production of Zinc Stearate Particles

Particles of a metal salt of a fatty acid (particles of zinc stearate) are produced by classifying ADEKA Corporation's ZNS-S (particle diameter, 6.7 μm) using an elbow-jet classifier (EJ-L-3 (LABO), Nittetsu Mining Co., Ltd.). Sets of particles having a volume-average diameter of 3 μm, 5 μm, and 8 μm are used.

Production of Zinc Behenate Particles

Particles of zinc behenate having a volume-average diameter of 5 μm are produced by classifying Nitto Kasei Kogyo K.K.'s ZS-7 zinc behenate (particle diameter, 15.4 μm) using an elbow-jet classifier (EJ-L-3 (LABO), Nittetsu Mining Co., Ltd.).

Production of Zinc Montanate Particles

Particles of zinc montanate having a volume-average diameter of 5 μm are produced by classifying Nitto Kasei Kogyo K.K.'s ZS-8 zinc montanate (particle diameter, 14.4 μm) using an elbow-jet classifier (EJ-L-3 (LABO), Nittetsu Mining Co., Ltd.).

Production of a Liquid Dispersion of Amorphous-Resin Particles

Production of Liquid Dispersion (A1) of Amorphous-Polyester-Resin Particles

Terephthalic acid: 70 parts
Fumaric acid: 30 parts
Ethylene glycol: 41 parts
1,5-Pentanediol: 48 parts A flask equipped with a stirrer, a nitrogen inlet tube, a temperature sensor, and a rectifying column is charged with the above materials. With a stream of nitrogen into the flask, the temperature is increased to 220° C. over 1 hour. Then 1 part of titanium tetraethoxide is added to 100 parts of the above materials. The temperature is increased to 240° C. over 0.5 hours while the water produced is removed, and dehydration condensation is continued for 1 hour at this temperature. Cooling the reaction product gives an amorphous polyester resin having a weight-average molecular weight of 96,000 and a glass transition temperature of 61° C.

Forty parts of ethyl acetate and 25 parts of 2-butanol are mixed together in a container equipped with a temperature controller and a nitrogen purging system. One hundred parts of the amorphous polyester resin is dissolved in the solvent mixture by adding the resin little by little. The resulting solution is stirred with a 10% aqueous solution of ammonia (amount equivalent to three times, by molar ratio, the acid value of the resin) for 30 minutes. After the container is purged with dry nitrogen, the resin is emulsified by adding 400 parts of deionized water at a rate of 2 parts/min with stirring at a constant temperature of 40° C. Returning the resulting emulsion to 25° C. gives a liquid dispersion of resin particles having a volume-average diameter of 190 nm. The solids content of this liquid dispersion of resin particles is adjusted to 20% with deionized water. The resulting dispersion is liquid dispersion (A1) of amorphous-polyester-resin particles.

Production of a Liquid Dispersion of Crystalline-Polyester-Resin Particles

Production of Liquid Dispersion (B2) of Crystalline-Polyester-Resin Particles 1,10-Decanedicarboxylic acid: 265 parts
1,6-Hexanediol: 168 parts
Dibutyltin oxide (catalyst): 0.4 parts The above ingredients are put into a three-neck flask dried by heating. After the atmosphere inside the flask is made inert by depressurization and nitrogen purging, the ingredients are mechanically stirred with reflux at 180° C. for 5 hours. Then the mixture is heated gently to 230° C. and stirred for 2 hours under reduced pressure. When the mixture becomes viscous, the reaction is terminated by air-cooling. The resulting crystalline polyester resin has a weight-average molecular weight (Mw) (polystyrene-equivalent) of 13,000 and a melting temperature of 69° C. A mixture of 90 parts of the resin, 1.5 parts of Neogen RK ionic surfactant (DKS Co., Ltd.), and 200 parts of deionized water is heated to 120° C., the resin is thoroughly dispersed using IKA's ULTRA-TURRAX T50, and then the resin is further dispersed for 1 hour using a pressure-pump Gaulin homogenizer. The resulting dispersion is liquid dispersion (B2) of crystalline-polyester-resin particles. The volume-average diameter of the particles is 210 nm, and the solids content is 23 parts by mass.

Preparation of a Liquid Dispersion of Coloring-Agent Particles

Carbon black (Regal 330, Cabot): 50 parts
An anionic surfactant (Neogen RK, DKS Co., Ltd.): 5 parts Deionized water: 193 parts A liquid dispersion of coloring-agent particles (solids concentration, 20%) is prepared by mixing the above ingredients together and processing the mixture for 10 minutes at 240 MPa using an Ultimaizer (Sugino Machine). Preparation of Liquid Dispersions of Release-Agent Particles Preparation of Liquid Dispersion (W1) of Release-Agent Particles An ester wax (WEP-5, NOF Corporation; melting temperature, 85° C.): 100 parts An anionic surfactant (Neogen RK, DKS Co., Ltd.): 1 part Deionized water: 350 parts The above materials are mixed together, and the mixture is heated to 100° C. The wax is dispersed using a homogenizer (ULTRA-TURRAX T50, IKA) and then further dispersed using a Manton-Gaulin high-pressure homogenizer (Gaulin). This gives a liquid dispersion of release-agent particles (solids content, 20%). The volume-average diameter of the particles is 220 nm.

Preparation of Liquid Dispersion (W2) of Release-Agent Particles

A paraffin wax (HNP-0190, Nippon Seiro Co., Ltd; melting temperature, 89° C.): 100 parts An anionic surfactant (Neogen RK, DKS Co., Ltd.): 1 part Deionized water: 350 parts The above materials are mixed together, and the mixture is heated to 100° C. The wax is dispersed using a homogenizer (ULTRA-TURRAX T50, IKA) and then further dispersed using a Manton-Gaulin high-pressure homogenizer (Gaulin). This gives a liquid dispersion of release-agent particles (solids content, 20%). The volume-average diameter of the particles is 220 nm.

Example 1

Production of Toner Particles 1

Deionized water: 200 parts

Liquid dispersion (A1) of amorphous-polyester-resin particles: 200 parts

Liquid dispersion (W1) of release-agent particles: 10 parts

The liquid dispersion of coloring-agent particles: 20 parts

An anionic surfactant (Neogen RK, DKS Co., Ltd.; 20%): 2.8 parts

The above ingredients are put into a reactor equipped with a thermometer, a pH meter, and a stirrer and are stirred for 30 minutes at a constant rate of 150 rpm and a constant temperature of 30° C. while the temperature is controlled from the outside using a mantle heater. Then the pH is adjusted to 3.0 with a 0.3 N (=0.3 mol/L) nitric acid in preparation for aggregation.

The particles are dispersed using a homogenizer (ULTRA-TURRAX T50, IKA), and at the same time an aqueous solution of 0.7 parts of polyaluminum chloride (PAC, Oji Paper Co., Ltd.; 30% powder) in 7 parts of deionized water is added. The temperature is increased to 44° C. with stirring, and the diameter of the particles is measured using Coulter Multisizer II (aperture size, 50 μm; Coulter) to ensure that the volume-average diameter of the particles is 3.5 μm. Then a mixture of 30 parts of liquid dispersion (A1) of amorphous-polyester-resin particles and 15 parts of liquid dispersion (B1) of crystalline-polyester-resin particles is added. Thirty minutes later, a mixture of 30 parts of liquid dispersion (A1) of amorphous-polyester-resin particles and 15 parts of liquid dispersion (B1) of crystalline-polyester-resin particles is added once again.

This addition of extra dispersions is repeated a total of four times. That is, a mixture of 30 parts of liquid dispersion (A1) of amorphous-polyester-resin particles and 15 parts of liquid dispersion (B1) of crystalline-polyester-resin particles is added four times.

Lastly, 47 parts of liquid dispersion (A1) of amorphous-polyester-resin particles is added to make particles of an amorphous polyester resin adhere to the surface of aggregates.

Then 20 parts of a 10% aqueous solution of a NTA (nitrilotriacetic acid) metal salt (CHELEST 70, Chelest Corporation) is added, and the pH is brought to 9.0 with a 1 N (=1 mol/L) aqueous solution of sodium hydroxide. The resulting slurry is heated to 90° C. at a rate of 0.05° C./min, kept at 90° C. for 3 hours, and then cooled to 30° C. The slurry is then heated at a rate of 0.05° C./min to 87° C., which is higher than the melting temperature of the crystalline resin minus 5° C., kept at this temperature for 30 minutes, cooled to 30° C. slowly, at 0.5° C./min, and then filtered. The resulting crude toner particles are washed by repeating dispersion in deionized water and filtration until the electrical conductivity of the filtrate is 20 μS/cm or less. Separately, 8.5 parts of magnesium chloride, a source of the Mg element, is dissolved in 80 parts of deionized water, and 20 parts of sodium chloride is dissolved in 80 parts of deionized water. To the crude toner particles washed and collected by filtration, 105 parts of the aqueous solution of magnesium chloride and 208 parts of the aqueous solution of sodium chloride are added. Vacuum-drying the resulting mixture in an oven at 40° C. for 5 hours gives toner particles having a volume-average diameter of 4.0 μm (toner particles 1).

Production of Toner 1

One hundred parts of toner particles 1 are mixed and blended with the external additives specified in Table 1 and 1.5 parts by mass of hydrophobic silica (RY50, Nippon Aerosil; number-average particle diameter, 140 nm) at 10,000 rpm for 30 seconds using a sample mill. The amounts of the external additives are as given in Table 1. The resulting mixture is sieved through a 45-μm mesh vibrating sieve to give toner (toner 1). Toner 1 has a volume-average particle diameter of 4.0 μm.

Production of a Carrier

Five hundred parts of spherical particles of magnetite (volume-average diameter, 0.55 μm) are thoroughly stirred in a Henschel mixer, and 5.0 parts of a titanate coupling agent is added. The materials are mixed by stirring for 30 minutes at an elevated temperature of 100° C., giving spherical particles of magnetite coated with a titanate coupling agent.

Then 500 parts of the coated magnetite particles are put into a four-neck flask and mixed, by stirring, with 6.25 parts of phenol, 9.25 parts of 35% formalin, 6.25 parts of 25% ammonia solution, and 425 parts of water. The materials are allowed to react at 85° C. for 120 minutes with stirring and then cooled to 25° C. The precipitate is washed with water by adding 500 parts of water and removing the supernatant. The washed precipitate is dried at 150° C. or more and 180° C. or less under reduced pressure, giving a carrier having an average particle diameter of 35 μm.

Production of Electrostatic Charge Image Developer 1

The resulting carrier and toner 1 are put into a V-blender in a ratio of 5:95 (toner:carrier; by mass) and stirred for 20 minutes. The resulting mixture is electrostatic charge image developer 1.

Measurement of the Net Intensity of the Peak for the Mg Element in the Toner in an X-Ray Fluorescence Analysis To quantify magnesium, the toner is analyzed by x-ray fluorescence as follows. Approximately 5 g of the toner (including the external additives) is compressed using a compression molding machine under a load of 10 t for 60 seconds to give a 50-mm diameter and 2-mm thick disk 50 mm across and 2 mm thick. This sample disk is qualitatively and quantitatively analyzed for chemical elements therein under the conditions below using a scanning x-ray fluorescence spectrometer (Rigaku ZSX Primus II). In the resulting spectrum, the net intensity of the peak for the Mg element (in kcps, kilo-counts per second) is determined.

Tube voltage: 40 kV

Tube current: 70 mA

Anticathode material: Rhodium

Duration of measurement: 15 minutes

Spot diameter: 10 mm

Testing for Density Unevenness and Voids in Images

A sample image including a 50 mm×420 mm vertical band chart is produced on 10,000 sheets of A3 J paper (Fuji Xerox Co., Ltd.) over two days under 28.5° C. and 85% RH conditions using a modified version of DocuCentre Color 400 (Fuji Xerox Co., Ltd.). After producing 10,000 images, the modified printer is shut down, placed under 48° C. and 95% RH conditions, and left for 48 hours. The printer is then placed under 28.5° C. and 85% RH conditions and left for 17 hours for tempering. A sample image including a 50 mm×420 mm vertical band chart is printed on 7,000 sheets of A3 J paper (Fuji Xerox Co., Ltd.) within a day. The image is checked once every 1,000 sheets.

Density Unevenness

Density unevenness is graded according to the following criteria. Grades A to D indicate acceptable unevenness.

A: The image and non-image portions of the photoreceptor look the same, and the images are of acceptable quality.

B: A minor difference in gloss is visible between the image and non-image portions of the photoreceptor, but the images are of acceptable quality.

C: A difference in gloss is visible between the image and non-image portions of the photoreceptor, but the images are of acceptable quality.

D: A difference in gloss is visible between the image and non-image portions of the photoreceptor. The images have minor voids but are of acceptable quality.

E: A clear difference in gloss is visible between the image and non-image portions of the photoreceptor, and the images have voids.

F: Voids are noticeable in the images.

Voids in the Image

The clogging of the trimmer (voids in the image) is graded according to the following criteria. Grades A to C indicate acceptable voids.

A: No irregularities or streaks corresponding to the structure of the developer brush are visible on the sleeve, and the images are of acceptable quality.

B: Minor irregularities corresponding to the structure of the developer brush are visible on the sleeve, but the images are of acceptable quality.

C: Streaks made by the developer brush are visible on the sleeve, but the images are of acceptable quality.

D: Streaks made by the developer brush are noticeable on the sleeve, and the images have voids. Characterization of the Toner Particles The following characteristics of the toner particles are determined as stated earlier herein.

The aspect ratio of domains of the crystalline resin (Aspect ratio AR in the table)

The length of domains of the crystalline resin along their major axis (Major-axis length $L_{cry}$ in the table)

The percentage of the length of domains of the crystalline resin along their major axis ($L_{cry}$ in the table) to the longest diameter of the toner particle The angle between a line extended from the major axis of domains of the crystalline resin and the tangent to the surface of the toner particle at the point of contact between the extended line and the surface (Major axis-to-tangent angle $\theta_A$ in the table)

The angle between lines extended from the major axis of two domains of the crystalline resin (Angle between extended major axes $\theta_B$ in the table)

The shortest distance between domains of the release agent in the toner particle and the surface (outer edge) of the toner particle (Shortest distance between release-agent domains and toner-particle surface in the table)

The percentage of toner particles meeting the following conditions (toner particles A) to all toner particles (% by number)

Condition (A): Each domain of the crystalline resin has an aspect ratio of 5 or more and 40 or less.

Condition (B1): Each domain of the crystalline resin measures 0.5 μm or more and 1.5 μm or less along its major axis.

Condition (C): A line extended from the major axis of each domain of the crystalline resin makes an angle of 60° or more and 90° or less with the tangent to the surface of the toner particle at the point of contact between the extended line and the surface.

Condition (D): Lines extended from the major axis of the two domains of the crystalline resin cross each other at an angle of 45° or more and 90° or less.

The percentage of toner particles meeting the following conditions (toner particles B) to all toner particles (% by number)

Condition (A'): Each domain of the crystalline resin has an aspect ratio of 10 or more and 40 or less.

Condition (B1'): Each domain of the crystalline resin measures 0.8 μm or more and 1.5 μm or less along its major axis.

Condition (C'): A line extended from the major axis of each domain of the crystalline resin makes an angle of 75° or more and 90° or less with the tangent to the surface of the toner particle at the point of contact between the extended line and the surface.

Condition (D'): Lines extended from the major axis of the two domains of the crystalline resin cross each other at an angle of 60° or more and 90° or less.

The percentage of toner particles meeting the following conditions (toner particles C) to all toner particles (% by number)

Condition (A): Each domain of the crystalline resin has an aspect ratio of 5 or more and 40 or less.

Condition (B2): Each domain of the crystalline resin measures, along its major axis, 10% or more and 30% or less of the longest diameter of the toner particle.

Condition (C): A line extended from the major axis of each domain of the crystalline resin makes an angle of 60° or more and 90° or less with the tangent to the surface of the toner particle at the point of contact between the extended line and the surface.

Condition (D): Lines extended from the major axis of the two domains of the crystalline resin cross each other at an angle of 45° or more and 90° or less.

The percentage of toner particles meeting the following conditions (toner particles D) to all toner particles (% by number)

Condition (A'): Each domain of the crystalline resin has an aspect ratio of 10 or more and 40 or less.

Condition (B2'): Each domain of the crystalline resin measures, along its major axis, 13% or more and 30% or less of the longest diameter of the toner particle.

Condition (C'): A line extended from the major axis of each domain of the crystalline resin makes an angle of 75° or more and 90° or less with the tangent to the surface of the toner particle at the point of contact between the extended line and the surface.

Condition (D'): Lines extended from the major axis of the two domains of the crystalline resin cross each other at an angle of 60° or more and 90° or less.

Examples 2 to 19 and Comparative Examples 1 and 2

A toner and an electrostatic charge image developer are produced and tested as in Example 1. The toner particles, the particles of formula (1) and their quantity, and the metal salt particles and their quantity are changed as indicated in Table 1. The test results are presented in Table 1.

Toner particles 2 to 9 are produced as follows.

Production of Toner Particles 2

Toner particles are produced in the same way as toner particles 1, except that the diameter of particles before the addition of extra dispersions is changed to 4.1 μm. This gives toner particles having a volume-average diameter of 4.7 μm (toner particles 2).

Production of Toner Particles 3

Toner particles are produced in the same way as toner particles 1, except that the diameter of particles before the addition of extra dispersions is changed to 5.1 μm. This gives toner particles having a volume-average diameter of 5.8 μm (toner particles 3).

Production of Toner Particles 4

Toner particles are produced in the same way as toner particles 1, except that the diameter of particles before the addition of extra dispersions is changed to 6.4 μm. This gives toner particles having a volume-average diameter of 7.0 μm (toner particles 4).

Production of Toner Particles 5

Toner particles are produced in the same way as toner particles 3, except that the amount of the magnesium chloride to serve as a source of the Mg element is changed to 4.0 parts. The resulting toner particles, having a volume-average diameter of 5.8 μm, are toner particles 5.

Production of Toner Particles 6

Toner particles are produced in the same way as toner particles 3, except that the amount of the magnesium chloride to serve as a source of the Mg element is changed to 20 parts. The resulting toner particles, having a volume-average diameter of 5.8 μm, are toner particles 6.

Production of Toner Particles 7

Toner particles are produced in the same way as toner particles 1, except that the amount of the magnesium chloride to serve as a source of the Mg element is changed to 2.0 parts and that the diameter of particles before the addition of extra dispersions is changed to 3.0 μm. This gives toner particles having a volume-average diameter of 3.8 μm (toner particles 7).

Production of Toner Particles 8

Toner particles are produced in the same way as toner particles 1, except that the amount of the magnesium chloride to serve as a source of the Mg element is changed to 30 parts and that the diameter of particles before the addition of extra dispersions is changed to 6.9 μm. This gives toner particles having a volume-average diameter of 7.5 μm (toner particles 8).

Production of Toner Particles 9

Toner particles are produced in the same way as toner particles 1, except that the diameter of particles before the addition of extra dispersions is changed to 5.1 μm and that the rate of heating in the second round of heating, 0.05° C./min, is changed to 15° C./min. The resulting toner particles, having a volume-average diameter of 5.8 μm, are toner particles 9.

TABLE 1

| | Net intensity (kcps) of x-ray fluorescence from the Mg element in the toner | Toner particles | | Particles of formula (1) | | | | Metal salt particles | | | Test results | |
|---|---|---|---|---|---|---|---|---|---|---|---|---|
| | | Type | Volume-average diameter D (μm) | Type | Average primary-particle diameter d1 (μm) | Quantity (parts by mass) | D/d1 | Type | Volume-average diameter d2 (μm) | Quantity (parts by mass) | Density unevenness | Voids in images |
| Example 1 | 0.25 | 1 | 4.0 | $CaTiO_3$-1 | 0.1 | 0.2 | 40 | ZnSt (C18) | 3 | 0.20 | A | A |
| Example 2 | 0.24 | 2 | 4.7 | $CaTiO_3$-1 | 0.1 | 0.2 | 47 | ZnSt (C18) | 3 | 0.20 | A | A |
| Example 3 | 0.26 | 3 | 5.8 | $CaTiO_3$-1 | 0.1 | 0.2 | 58 | ZnSt (C18) | 3 | 0.20 | A | A |
| Example 4 | 0.25 | 4 | 7.0 | $CaTiO_3$-1 | 0.1 | 0.2 | 70 | ZnSt (C18) | 3 | 0.20 | A | A |
| Example 5 | 0.26 | 3 | 5.8 | $CaTiO_3$-2 | 0.05 | 0.2 | 116 | ZnSt (C18) | 3 | 0.20 | A | A |
| Example 6 | 0.26 | 3 | 5.8 | $CaTiO_3$-3 | 0.15 | 0.2 | 39 | ZnSt (C18) | 3 | 0.20 | A | A |
| Example 7 | 0.26 | 3 | 5.8 | $SrTiO_3$-1 | 0.1 | 0.2 | 58 | ZnSt (C18) | 3 | 0.20 | A | A |
| Example 8 | 0.26 | 3 | 5.8 | $BaTiO_3$-1 | 0.1 | 0.2 | 58 | ZnSt (C18) | 3 | 0.20 | A | A |
| Example 9 | 0.26 | 3 | 5.8 | $CaTiO_3$-1 | 0.1 | 0.2 | 58 | ZnSt (C18) | 3 | 0.20 | A | A |
| Example 10 | 0.26 | 3 | 5.8 | $CaTiO_3$-1 | 0.1 | 0.2 | 58 | ZnSt (C18) | 3 | 0.20 | A | A |
| Example 11 | 0.26 | 3 | 5.8 | $CaTiO_3$-4 | 0.4 | 0.2 | 15 | ZnSt (C18) | 3 | 0.20 | A | A |
| Example 12 | 0.26 | 3 | 5.8 | $CaTiO_3$-1 | 0.1 | 0.2 | 58 | ZnSt (C18) | 3 | 0.20 | A | A |
| Example 13 | 0.26 | 3 | 5.8 | $CaTiO_3$-1 | 0.1 | 0.2 | 58 | ZnSt (C18) | 5 | 0.20 | A | A |
| Example 14 | 0.26 | 3 | 5.8 | $CaTiO_3$-1 | 0.1 | 0.2 | 58 | ZnSt (C18) | 8 | 0.20 | C | A |
| Example 15 | 0.26 | 3 | 5.8 | $CaTiO_3$-1 | 0.1 | 0.2 | 58 | Zinc behenate (C22) | 5 | 0.20 | C | B |
| Example 16 | 0.26 | 3 | 5.8 | $CaTiO_3$-1 | 0.1 | 0.2 | 58 | Zinc montanate (C28) | 5 | 0.20 | C | B |

TABLE 1-continued

| | Net intensity (kcps) of x-ray fluorescence from the Mg element in the toner | Toner particles Type | Toner particles Volume-average diameter D (μm) | Particles of formula (1) Type | Particles of formula (1) Average primary-particle diameter d1 (μm) | Particles of formula (1) Quantity (parts by mass) | Particles of formula (1) D/d1 | Metal salt particles Type | Metal salt particles Volume-average diameter d2 (μm) | Metal salt particles Quantity (parts by mass) | Test results Density unevenness | Test results Voids in images |
|---|---|---|---|---|---|---|---|---|---|---|---|---|
| Example 17 | 0.26 | 3 | 5.8 | $CaTiO_3$-5 | 0.03 | 0.2 | 193 | ZnSt (C18) | 3 | 0.20 | D | C |
| Example 18 | 0.26 | 3 | 5.8 | $CaTiO_3$-6 | 5 | 0.2 | 1.2 | ZnSt (C18) | 3 | 0.20 | C | C |
| Example 19 | 0.26 | 9 | 5.8 | $CaTiO_3$-1 | 0.1 | 0.2 | 58 | ZnSt (C18) | 3 | 0.20 | B | B |
| Comparative Example 1 | 0.05 | 7 | 3.8 | $CaTiO_3$-1 | 0.1 | 0.02 | 38 | ZnSt (C18) | 3 | 0.20 | E | D |
| Comparative Example 2 | 1.4 | 8 | 7.5 | $CaTiO_3$-1 | 0.1 | 6 | 75 | ZnSt (C18) | 3 | 0.20 | F | D |

Characteristics of toner particles 1 to 9 are presented in Table 2.

TABLE 2

| Toner particles Type | Toner particles Volume-average diameter D μm | Toner particles Mg content kcps | Domain A of the crystalline resin Aspect ratio AR — | Domain A of the crystalline resin Major-axis length $L_{cry}$ μm | Domain A of the crystalline resin Percentage of the major-axis length to the longest diameter of the toner particle % | Domain A of the crystalline resin Major axis-to-tangent angle $\theta_A$ Degrees | Domain B of the crystalline resin Aspect ratio AR — | Domain B of the crystalline resin Major-axis length $L_{cry}$ μm |
|---|---|---|---|---|---|---|---|---|
| 1 | 4.0 | 0.25 | 22 | 1.1 | 28 | 84 | 21 | 1.1 |
| 2 | 4.7 | 0.24 | 23 | 1.2 | 26 | 81 | 20 | 1.1 |
| 3 | 5.8 | 0.26 | 24 | 1.2 | 21 | 79 | 21 | 1.0 |
| 4 | 7.0 | 0.25 | 20 | 1.1 | 16 | 80 | 19 | 1.0 |
| 5 | 5.8 | 0.1 | 21 | 1.3 | 22 | 83 | 20 | 1.2 |
| 6 | 5.8 | 1.2 | 24 | 1.2 | 21 | 81 | 22 | 1.1 |
| 7 | 3.8 | 0.05 | 22 | 1.2 | 32 | 83 | 22 | 1.0 |
| 8 | 7.5 | 1.4 | 23 | 1.2 | 16 | 84 | 23 | 1.1 |
| 9 | 5.8 | 0.26 | 3 | 0.2 | 5 | 53 | 2 | 0.3 |

| Toner particles Type | Domain B of the crystalline resin Percentage of the major-axis length to the longest diameter of the toner particle % | Domain B of the crystalline resin Major axis-to-tangent angle $\theta_A$ Degrees | Angle between extended major axes of domains A and B $\theta_B$ Degrees | Percentage of toner particles meeting conditions (% by number) Toner particles A | Toner particles B | Toner particles C | Toner particles D |
|---|---|---|---|---|---|---|---|
| 1 | 28 | 81 | 76 | 94 | 78 | 92 | 77 |
| 2 | 23 | 80 | 81 | 93 | 77 | 91 | 77 |
| 3 | 17 | 78 | 77 | 92 | 80 | 91 | 80 |
| 4 | 14 | 79 | 78 | 91 | 78 | 91 | 77 |
| 5 | 21 | 81 | 79 | 93 | 78 | 93 | 76 |
| 6 | 19 | 80 | 78 | 94 | 79 | 92 | 78 |
| 7 | 26 | 79 | 75 | 92 | 78 | 91 | 77 |
| 8 | 15 | 78 | 77 | 93 | 77 | 90 | 76 |
| 9 | 4 | 39 | 51 | 0 | 0 | 0 | 0 |

The results indicate that the Examples may give images with few voids compared with the Comparative Examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A toner for developing an electrostatic charge image, the toner comprising:

toner particles containing at least one binder resin;

a Mg element in an amount such that a net intensity of x-ray fluorescence from the Mg element in the toner is 0.10 kcps or more and 1.20 kcps or less; and external additives including particles of at least one compound represented by formula (1) below and particles of a metal salt of a fatty acid, $$MTiO_3 \quad (1)$$

where M represents at least one selected from the group consisting of Ca, Sr, and Ba;

wherein the binder resin includes an amorphous resin and at least one crystalline resin, wherein in a cross-sectional observation of the toner particles, there are toner particles in which at least two domains of the crystalline resin meet condition (B1) or (B2) below:

condition (B1) that each domain of the crystalline resin measures 0.5 μm or more and 1.5 μm or less along a major axis thereof condition (B2) that at least one of the two domains of the crystalline resin measures that along a major axis thereof that 10% or more and 30% or less of a longest diameter of the toner particle, and in a cross-sectional observation of the toner particles, there are toner particles in which at least two domains of the crystalline resin meet conditions (A), (C), and (D) below:

condition (A) that each domain of the crystalline resin has an aspect ratio of 5 or more and 40 or less;

condition (C) that a line extended from the major axis of each domain of the crystalline resin makes an angle of 60° or more and 90° or less with a tangent to a surface of the toner particle at a point of contact between the extended line and the surface; and condition (D) that lines extended from the major axis of the two domains of the crystalline resin cross each other at an angle of 45° or more and 90° or less.

2. The toner according to claim 1 for developing an electrostatic charge image, wherein the particles of at least one compound represented by formula (1) have an average primary-particle diameter of 30 nm or more and 3000 nm or less.

3. The toner according to claim 2 for developing an electrostatic charge image, wherein the particles of at least one compound represented by formula (1) have an average primary-particle diameter of 70 nm or more and 130 nm or less.

4. The toner according to claim 1 for developing an electrostatic charge image, wherein a ratio D/d1 between a volume-average diameter D of the toner particles and an average primary-particle diameter d1 of the particles of at least one compound represented by formula (1) is 1.9 or more and 200 or less.

5. The toner according to claim 2 for developing an electrostatic charge image, wherein a ratio D/d1 between a volume-average diameter D of the toner particles and an average primary-particle diameter d1 of the particles of at least one compound represented by formula (1) is 1.9 or more and 200 or less.

6. The toner according to claim 4 for developing an electrostatic charge image, wherein the ratio D/d1 between a volume-average diameter D of the toner particles and an average primary-particle diameter d1 of the particles of at least one compound represented by formula (1) is 10 or more and 100 or less.

7. The toner according to claim 1 for developing an electrostatic charge image, wherein the particles of a metal salt of a fatty acid are particles of a zinc salt of a fatty acid.

8. The toner according to claim 7 for developing an electrostatic charge image, wherein the particles of a metal salt of a fatty acid are particles of zinc stearate.

9. The toner according to claim 1 for developing an electrostatic charge image, wherein the crystalline resin includes at least one polycondensate of a linear aliphatic α,ω-dicarboxylic acid and a linear aliphatic α,ω-diol.

10. The toner according to claim 9 for developing an electrostatic charge image, wherein the polycondensate of a linear aliphatic α,ω-dicarboxylic acid and a linear aliphatic α,ω-diol includes a polycondensate of 1,10-decanedicarboxylic acid and 1,6-hexanediol.

11. The toner according to claim 1 for developing an electrostatic charge image, wherein:

the toner particles further contain at least one release agent; and the release agent includes an ester wax.

12. The toner according to claim 11 for developing an electrostatic charge image, wherein the release agent includes an ester wax formed by a C10 to C30 higher fatty acid and a monohydric or polyhydric C1 to C30 alcohol component.

13. An electrostatic charge image developer comprising the toner according to claim 1 for developing an electrostatic charge image.

14. A toner cartridge that is attached to and detached from an image forming apparatus, the toner cartridge comprising the toner according to claim 1 for developing an electrostatic charge image.

15. A process cartridge that is attached to and detached from an image forming apparatus, the process cartridge comprising a developing component that contains the electrostatic charge image developer according to claim 13 and develops, using the electrostatic charge image developer, an electrostatic charge image on a surface of an image carrier to form a toner image.

16. An image forming apparatus comprising:

an image carrier;

a charging component that charges a surface of the image carrier;

an electrostatic charge image creating component that creates an electrostatic charge image on the charged surface of the image carrier;

a developing component that contains the electrostatic charge image developer according to claim 13 and develops, using the electrostatic charge image developer, the electrostatic charge image on the surface of the image carrier to form a toner image;

a transfer component that transfers the toner image on the surface of the image carrier to a surface of a recording medium; and a fixing component that fixes the toner image on the surface of the recording medium.

17. An image forming method comprising:

charging a surface of an image carrier;

creating an electrostatic charge image on the charged surface of the image carrier;

developing, using the electrostatic charge image developer according to claim 16, the electrostatic charge image on the surface of the image carrier to form a toner image;

transferring the toner image on the surface of the image carrier to a surface of a recording medium; and fixing the toner image on the surface of the recording medium.

* * * * *